United States Patent [19]

Kimura et al.

[11] Patent Number: 4,594,314

[45] Date of Patent: Jun. 10, 1986

[54] SILVER HALIDE COLOR PHOTOGRAPHIC LIGHT-SENSITIVE MATERIAL

[75] Inventors: Toshihiko Kimura, Hachioji; Takashi Sasaki, Hino; Yutaka Kaneko, Sagamihara, all of Japan

[73] Assignee: Konishiroku Photo Industry Co., Ltd., Tokyo, Japan

[21] Appl. No.: 752,003

[22] Filed: Jul. 5, 1985

Related U.S. Application Data

[63] Continuation of Ser. No. 526,882, Aug. 26, 1983, abandoned.

[30] Foreign Application Priority Data

Aug. 30, 1982 [JP] Japan ..... 57-151135

[51] Int. Cl.[4] ..... G03C 1/46; G03C 7/26

[52] U.S. Cl. ..... 430/506; 430/505; 430/549; 430/546; 430/552; 430/553

[58] Field of Search ..... 430/505, 549, 552, 553, 430/506, 546

[56] References Cited

U.S. PATENT DOCUMENTS

| | | | |
|---|---|---|---|
| 3,758,308 | 9/1973 | Beavers et al. | 430/553 |
| 3,880,661 | 4/1975 | Lau et al. | 430/552 |
| 4,275,145 | 6/1981 | Mikami et al. | 430/377 |
| 4,333,999 | 6/1982 | Lau | 430/553 |
| 4,427,767 | 1/1984 | Aoki et al. | 430/549 |

OTHER PUBLICATIONS

Research Disclosure, Item 17643, Dec. 1978.

*Primary Examiner*—Mary F. Downey

*Attorney, Agent, or Firm*—Finnegan, Henderson, Farabow, Garrett & Dunner

[57] ABSTRACT

A silver halide color photographic light-sensitive material comprising a support having thereon a lower-speed emulsion containing a phenol cyan coupler and a higher-speed emulsion containing a naphthol cyan coupler. Both the lower-speed emulsion and the higher-speed emulsion have the same color sensitivity.

21 Claims, 1 Drawing Figure

SILVER HALIDE COLOR PHOTOGRAPHIC LIGHT-SENSITIVE MATERIAL

This application is a continuation of application Ser. No. 526,882, filed Aug. 26, 1983, now abandoned.

BACKGROUND OF THE INVENTION

The present invention relates to a silver halide color photographic light-sensitive material, and more particularly to a silver halide color photographic light-sensitive material which comprises a cyan image forming layer capable of forming a cyan image having an excellent absorption spectrum, and which has a very excellent adaptability to processing.

Color images are usually obtained with the formation of dyes effected by the coupling reaction between the oxidized product of a color developing agent and couplers. In a multicolor photographic element, the subtractive color process is usually used to form a color image; the dye produced by the coupling is normally a cyan, magenta or yellow dye formed in or adjacently to a silver halide emulsion layer having its sensitivity to the wavelength region of the light that is to be absorbed by the image dye; i.e., a silver halide emulsion layer having its sensitivity to the red, green or blue region of the spectrum.

The characteristics which a coupler is required to have include, e.g., such a good color reproducibility that the color of the dye formed from it has a sharp-cut capability, and a good resistance to light, and the like.

As cyan couplers that meet such characteristics requirements, there have often been used phenol-type compounds or naphthol-type compounds. Particularly, naphthol-type compounds, since the dye formed therefrom has its absorption maximum (λmax) in a longer wavelength region and has little subabsorption in the green region, have been practically used in producing high-speed color negative light-sensitive materials.

However, most dyes formed from those couplers, whether of the naphthol type or of the phenol type, have a large shortcoming that they, when in contact with ferrous ions, become discolored. Namely, in an ordinary development method, there is produced a large amount of reduced ferrous ions in the bleaching or bleach-fixing process, which ions reduce and discolor the cyan dye that has been formed by color development, thus causing the development to become unstable.

Particularly, in recent years, there is a tendency that the developer's replenishing rate is reduced or the silver content of color light-sensitive materials is increased for the purpose of improving the sensitivity, image quality, etc. This is a tendency toward the increase in the ferrous ion concentration in the bleaching process, thus bringing about severer reduction-discoloration conditions against the cyan dye. In view of this, it is natural that there arises a need for the development of cyan couplers that will hardly be discolored.

As the coupler that causes no reduction discoloration of the cyan dye formed therefrom in the bleaching or bleach-fixing process, there are known those couplers in which the 2nd and 5th positions of phenol are substituted with an acylamino group, as described in U.S. Pat. No. 2,895,826, and Japanese Patent Publication Open to Public Inspection (hereinafter referred to as Japanese Patent O.P.I. Publication) Nos. 112038/1975, 109630/1978, 163537/1980, and the like. Any of these couplers has its absorption maximum in the shorter wavelength portion of the red region of the absorption spectrum of the formed dye, and also has much absorption in the green region, and thus it is undesirable for the color reproduction.

In addition, those phenol-type couplers having ureido group in the 2nd position of phenol are described in British Pat. No. 1,011,940, and U.S. Pat. Nos. 3,446,622, 3,996,253, 3,758,308 and 3,880,661. Any of these couplers, like the above-mentioned couplers, also has its absorption in the shorter wavelength portion of the red region of the absorption spectrum of the formed dye, the absorption being undesirably broad for the color reproduction, and some of these couplers form their dye that is discolored during the bleaching process; this is the drawback of these couplers.

On the other hand, as the coupler improved on the discoloration of the cyan dye formed therefrom, the absorption spectrum of which cyan dye has its absorption maximum in a relatively longer wavelength portion, there are known those couplers as described in Japanese Patent O.P.I. Publication No. 65134/1981, which are such that the 2nd position of phenol is substituted with a particular ureido group, but they are still not considered sufficient with respect to their absorption maximum wavelength.

Further, those ureido group-substituted phenol-type couplers as described in Japanese Patent Application Nos. 90334 to 90336/1981 and 131312 to 131314/1981 are ones capable of forming cyan dyes that are not discolored during the bleaching process, and the absorption spectrum of the resulting dye has its absorption maximum in a longer wavelength portion.

It has been found, however, that in the cyan dye formed from these ureido-substituted phenol-type couplers, in a higher color density area, the absorption maximum (λmax) in its absorption spectrum is in a considerably long wavelength portion of the red region, but, in a lower color density area, the λmax shifts toward the shorter wavelength side. Namely, it has become apparent that the λmax varies according to the density of a color image as illustrated in FIG. 1.

Thus, due to the change in the λmax, the color in a lower density area becomes more bluish than that in a higher density area. It goes without saying that it is an undesirable phenomenon, hindering the true reproduction of color. Accordingly, this is the reason that there is desired a color light-sensitive material the dye formed from which has no change in the λmax and has a sufficient absorption wavelength portion in its lower density area, and is not discolored.

It is therefore a first object of the present invention to provide a silver halide color photographic light-sensitive material capable of forming a cyan color image whose hue is little affected according to the change in the color density thereof.

It is a second object of the present invention to provide a silver halide color photographic light-sensitive material with the formed dye image thereon having in either a higher density area or a lower density area its λmax in a sufficiently long wavelength portion of the red region and having little absorption in the green region.

It is a third object of the present invention to provide a silver halide color photographic light-sensitive material whose developed dye image is little or not discolored by ferrous ions during the bleaching process.

SUMMARY OF THE INVENTION

The above-objects of the present invention is accomplished by a silver halide color photographic light-sensitive material comprising a support having thereon at least one light-sensitive silver halide emulsion layer, which light-sensitive silver halide emulsion layer contains a phenol-type cyan coupler having in the 2nd position thereof a group selected from the class consisting of phenyl-ureido, naphthyl-ureido and heterocyclic ureido groups, and having in the 5th position thereof an acylamino group (hereinafter referred to as "phenol-type cyan coupler of the invention"), and which light-sensitive silver halide emulsion layer and/or a light-sensitive silver halide emulsion layer other than which light-sensitive silver halide emulsion layer contain a naphthol-type cyan coupler which is substantially colorless and which has a hydrogen atom or a group which can be split off a compound which does not inhibit the development by the coupling reaction at a coupling position thereof with the oxidized product of an aromatic primary amine color developing agent (hereinafter referred to as "naphthol-type cyan coupler of the invention").

Namely, the incorporation of an ureido-substituted phenol-type cyan coupler and a naphthol-type cyan coupler into a same layer and/or different layers allows the formation of a cyan dye image whose change in the λmax, the shortcoming of ureido-substituted phenol-type couplers, is restrained, whose absorption is in a sufficiently long wavelength portion in either a higher density area or a lower density area, and which is little or not discolored by bleaching. This is a very peculiar phenomenon that cannot be estimated only from the effect of a simply combined use of couplers in the light of the fact that if the coupler to be used together with the ureido-substituted phenol-type coupler of the present invention is a coupler other than those of the present invention, the λmax's changeable range is far from being reduced, the range can become larger on the contrary.

Figure 1:
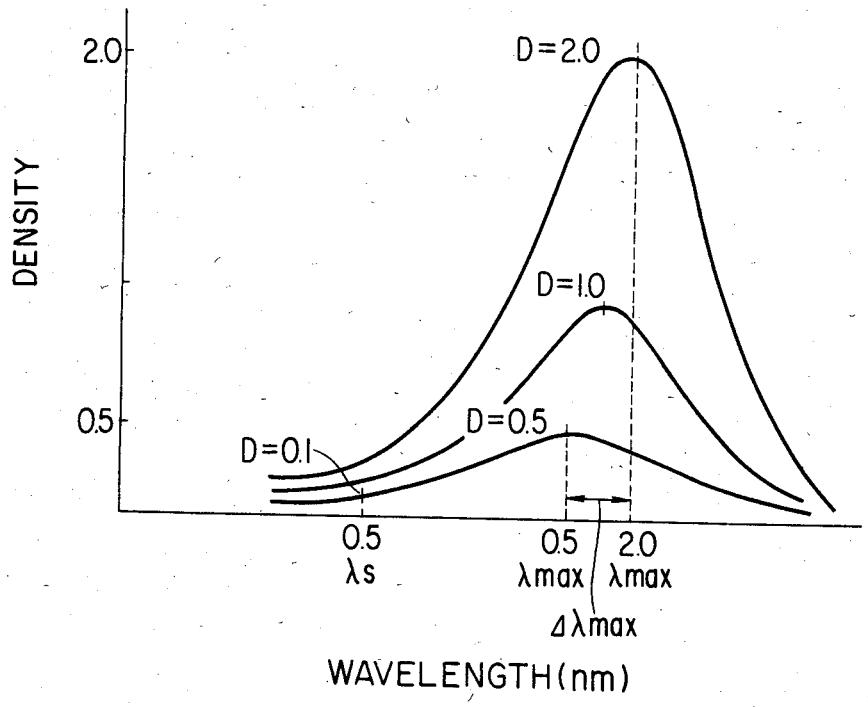
FIG. 1 is an illustration showing the spectra obtained when color-developing sample (1-1) in the example of the invention. This shows, as the density becomes lowered, the λmax shifts toward the shorter wavelength side.

The $\alpha_{max}^{2.0}$, $\lambda_{max}^{0.5}$, Δλmax, and $\lambda_s^{0.5}$ in FIG. 1 are the same as those used in the examples.

PREFERRED EMBODIMENTS

The above-mentioned ureido-substituted phenol-type cyan couplers are preferably those compounds having the following Formula [I], and naphthol-type couplers are preferably those having the following Formula [II].

Formula [I]

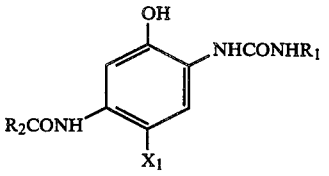

wherein $X_1$ is a hydrogen atom or a group splittable by the coupling with the oxidized product of an aromatic primary amine color developing agent; $R_1$ is a naphthyl or a heterocyclic group (provided the carbon atom of the heterocyclic group is coupled to the nitrogen atom of the ureido group) or a phenyl group having at least one substituent selected from the class consisting of trifluoromethyl, nitro, cyano, —COR, —COOR, —$SO_2R$, —$SO_2OR$,

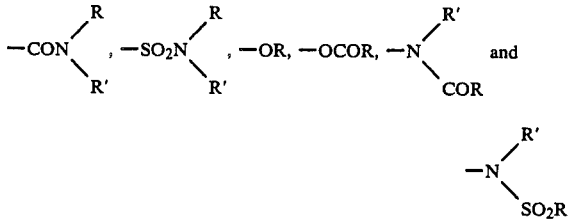

wherein R is an aliphatic group or an aromatic group, R is hydrogen, an aliphatic group or an aromatic group; and $R_2$ is a ballasting group necessary to cause the cyan coupler having Formula [I] and the cyan dye formed therefrom to be nondiffusible.

Formula [II]

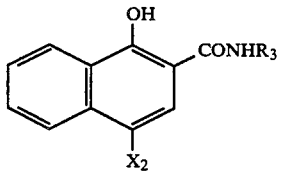

wherein $R_3$ is an aliphatic, an aromatic or a heterocyclic group preferably a ballasting group which causes the coupler as well as the cyan dye formed therefrom to be sufficiently nondiffusible; $X_2$ is hydrogen or a group which is split off by the coupling reaction with the oxidized product of a color developing agent and which, after the elimination, will not inhibit the development.

The preferred phenol-type cyan couplers in the present invention are particularly those having the following Formula [Ia] or Formula [Ib]:

Formula [Ia]

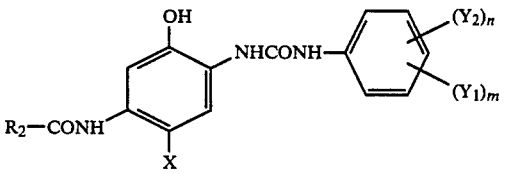

Formula [Ib]

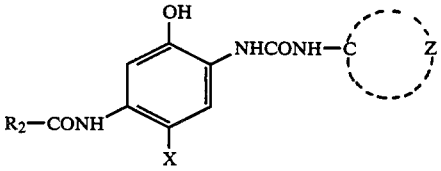

wherein $Y_1$ is trifluoromethyl, nitro, cyano, —COR, —COOR, —$SO_2R$, $SO_2OR$,

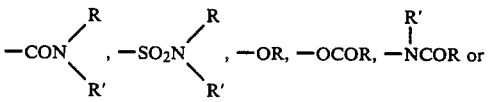

-continued $$-\overset{\overset{R'}{|}}{N}SO_2R;$$

R is an aliphatic group (preferably such an alkyl having from 1 to 10 carbon atoms as, e.g., methyl, butyl, cyclohexyl, benzyl) or an aromatic group (preferably a phenyl such as phenyl, tolyl); R' is hydrogen or a group represented by R; $Y_2$ is a monovalent group, and preferably an aliphatic group (preferably such an alkyl having from 1 to 10 carbon atoms as, e.g., methyl, t-butyl, ethoxyethyl, cyanomethyl), an aromatic group (preferably phenyl, naphthyl (such as, e.g., phenyl, tolyl), a halogen (such as fluorine, chlorine, bromine), amino group (such as ethylamino, diethylamino), hydroxy or a substituent represented by $Y_1$; m and n each is an integer of from 0 to 3, $m+n \leqq 5$; and Z is a group of nonmetallic atoms necessary to form a heterocyclic group or naphthyl group, which heterocyclic group is preferably a 5- or 6-member heterocyclic ring containing a nitrogen, oxygen, or sulfur atom, such as furyl, thienyl, pyridyl, quinolyl, oxazolyl, tetrazolyl, benzothiazolyl, tetrahydrofuranyl, or the like group. In addition, into any of these rings may be introduced an arbitrary substituent such as an alkyl group having from 1 to 10 carbon atoms (such as, e.g., ethyl, i-propyl, i-butyl, t-butyl, t-octyl), an aryl group (such as, e.g., phenyl, naphthyl), a halogen atom (such as fluorine, chlorine, bromine), cyano group, nitro group, a sulfonamido group (such as, e.g., methanesulfonamido, butanesulfonamido, p-toluenesulfonamido), a sulfamoyl group (such as, e.g., methyl sulfamoyl, phenyl sulfamoyl), a sulfonyl group (such as, e.g., methanesulfonyl, p-toluenesulfonyl), fluorosulfonyl group, a carbamoyl group (such as, e.g., dimethyl carbamoyl, phenyl carbamoyl), an oxycarbonyl group (such as, e.g., ethoxycarbonyl, phenoxycarbonyl), an acyl group (such as, e.g., acetyl, benzoyl), a heterocyclic group (such as, e.g., pyridyl, pyrazolyl), an alkoxy group, an aryloxy group, an acyloxy group, and the like.

$R_2$ represents an aliphatic group or an aromatic group necessary to cause a cyan coupler having Formula [I] and the cyan dye formed from the cyan coupler to be nondiffusible, which group is preferably an alkyl, an aryl or a heterocyclic group each having from 4 to 30 carbon atoms, such as, for example, a straight-chain or a branched-chain alkyl group (such as, e.g., t-butyl, n-octyl, t-octyl, n-dodecyl), an alkenyl group, a cycloalkyl group, a 5- or 6-member heterocyclic ring, or the like.

Preferred as $R_2$ are those groups having the following Formula [Ic]:

Formula [Ic]

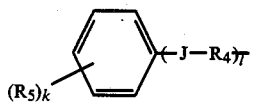

wherein J represents oxygen or sulfur; k is an integer of from 0 to 4, l is an integer of 0 or 1, where k is not less than 2 the not less than two $R_5$s each may be either the same or different; $R_4$ is a straight-chain or branched-chain alkylene group having from 1 to 20 carbon atoms; $R_5$ is a monovalent group such as, e.g., a hydrogen atom, a halogen atom (preferably chlorine or bromine), an alkyl group (preferably a straight-chain or branched-chain alkyl group having from 1 to 20 carbon atoms (such as, e.g., methyl, tert-butyl, tert-pentyl, tert-octyl, dodecyl, pentadecyl, benzyl, phenethyl)), an aryl group (such as phenyl), a heterocyclic group (preferably a nitrogen-containing heterocyclic group), an alkoxy group (preferably a straight-chain or branched-chain alkyloxy group having from 1 to 20 carbon atoms (such as, e.g., methoxy, ethoxy, tert-butyloxy, octyloxy, decyloxy, dodecyloxy)), an aryloxy group (such as phenoxy), hydroxy group, an acyloxy group (preferably an alkylcarbonyloxy group, an arylcarbonyloxy group (such as, e.g., acetoxy, benzoyloxy)), carboxy group, an alkoxycarbonyl group (preferably a straight-chain or branched-chain alkyloxycarbonyl group having from 1 to 20 carbon atoms), an aryloxycarbonyl group (preferably phenoxycarbonyl), an alkylthio group (preferably having from 1 to 20 carbon atoms), an acyl group (preferably a straight-chain or branched-chain alkyl-carbonyl having from 1 to 20 carbon atoms), an acylamino group (preferably a straight-chain or branched-chain alkylcarbonamido, benzenecarboamido each having from 1 to 20 carbon atoms), a sulfonamido group (preferably a straight-chain or branched-chain alkylsulfonamido, benzenesulfonamido each having from 1 to 20 carbon atoms), a carbamoyl group (preferably a straight-chain or branched-chain alkylaminocarbonyl, phenylaminocarbonyl each having from 1 to 20 carbon atoms), a sulfamoyl group (preferably a straight-chain or branched-chain alkylaminosulfonyl, phenylaminosulfonyl each having from 1 to 20 carbon atoms), or the like.

X is hydrogen or a group which can be split off during the coupling reaction with the oxidized product of a color developing agent, which group is such as an aryloxy, a carbamoyloxy, a carbamoylmethoxy, an acyloxy, a sulfonamido, a succinic acid imido, or the like group, to the coupling position of each of which is directly coupled a halogen atom (e.g., a chlorine, bromine or fluorine atom), an oxygen atom or a nitrogen atom. Further examples are as described in U.S. Pat. No. 3,741,563, Japanese Patent O.P.I Publication No. 37425/1972, Japanese Patent Examined Publication No. 36894/1973, Japanese Patent O.P.I. Publication Nos. 10135/1975, 117422/1975, 130441/1975, 108841/1976, 120334/1975, 18315/1977, 105226/1978, 14736/1979, 48237/1979, 32071/1980, 65957/1980, 1938/1981, 12643/1981, 27147/1981, and the like.

Any of the phenol-type cyan couplers of the present invention may be easily synthesized by use of the procedures described in, e.g., U.S. Pat. No. 3,758,308 and Japanese Patent O.P.I. Publication No. 65134/1981.

The following are the preferred examples of the phenol-type cyan couplers of the present invention, but the present invention is not limited thereto.

Exemplified Compounds

-continued
(I-1)
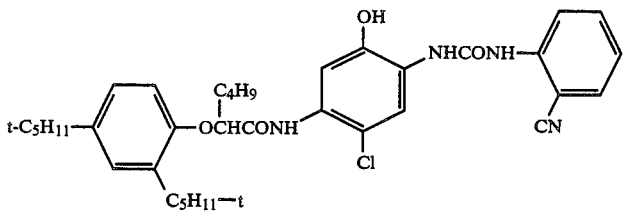
(I-2)
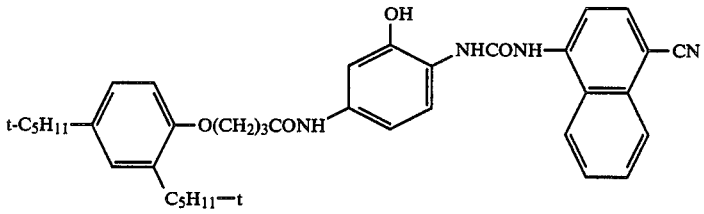
(I-3)
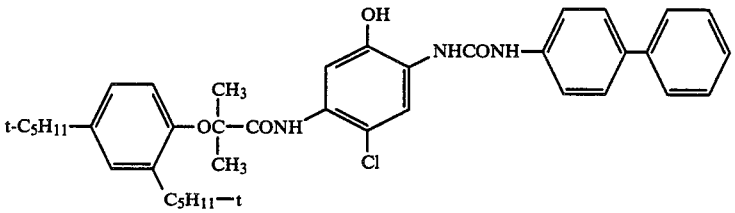
(I-4)
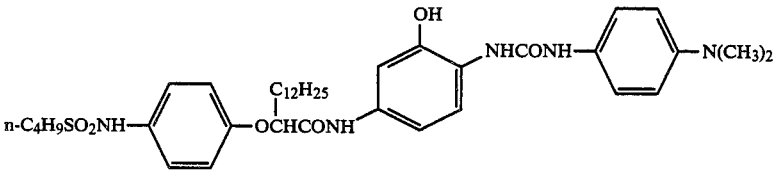
(I-5)
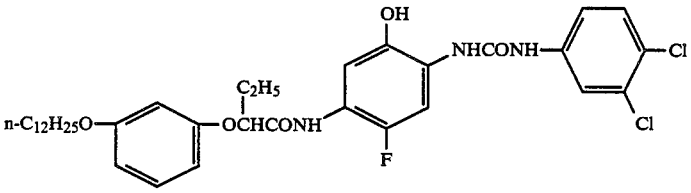
(I-6)
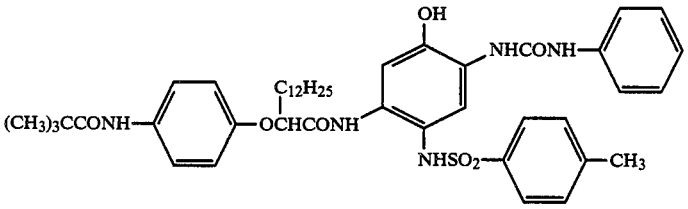
(I-7)
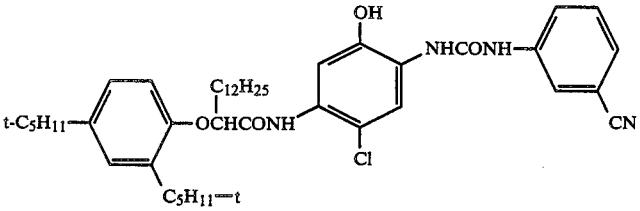

-continued
(I-8)
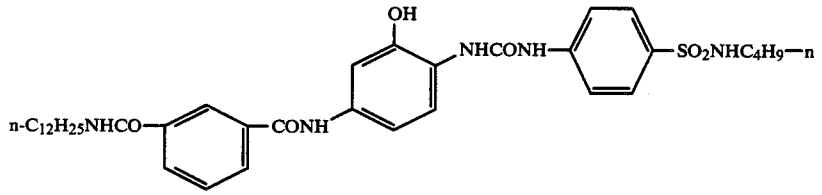
(I-9)
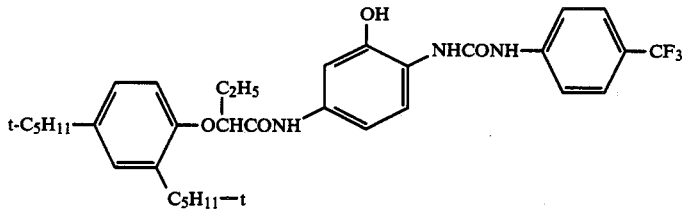
(I-10)
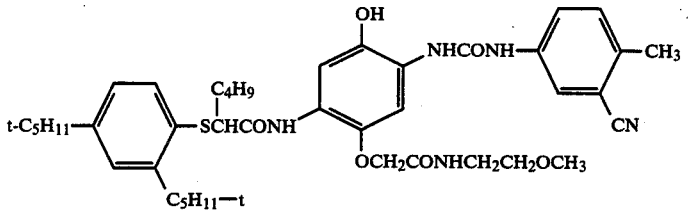
(I-11)
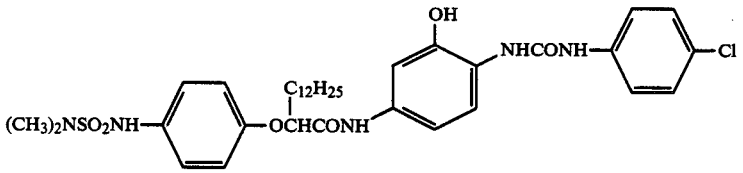
(I-12)
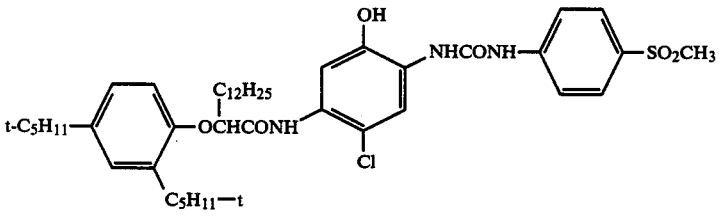
(I-13)
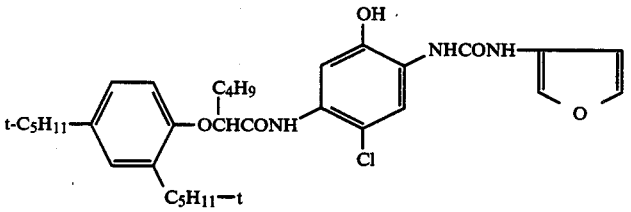
(I-14)
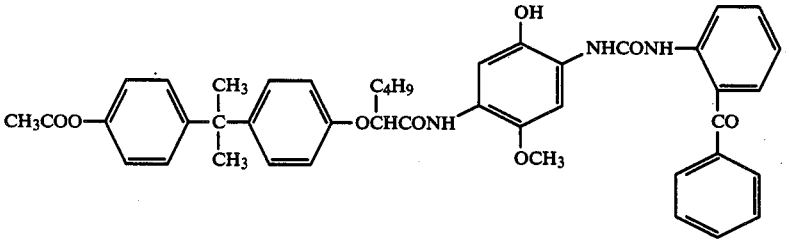

-continued
(I-15)
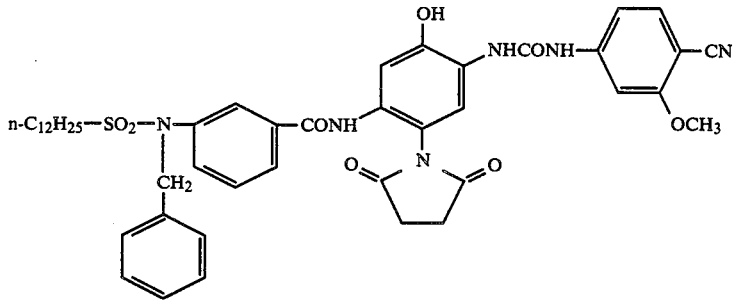
(I-16)
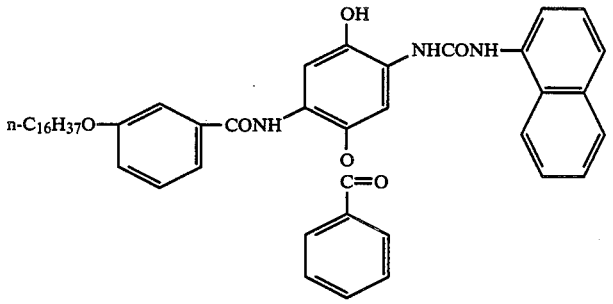
(I-17)
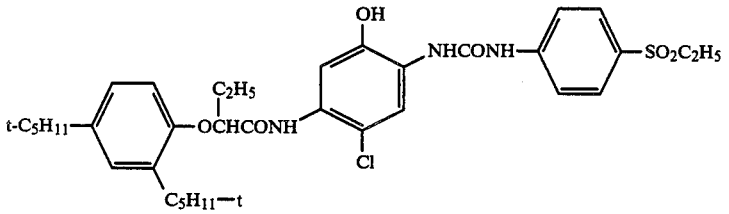
(I-18)
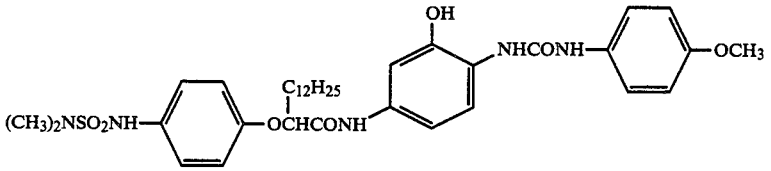
(I-19)
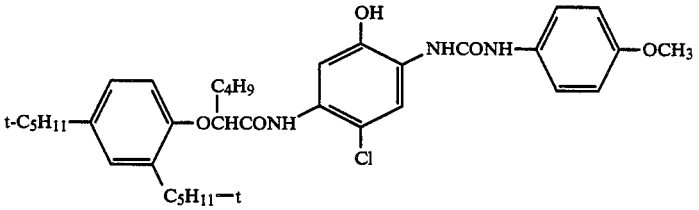
(I-20)
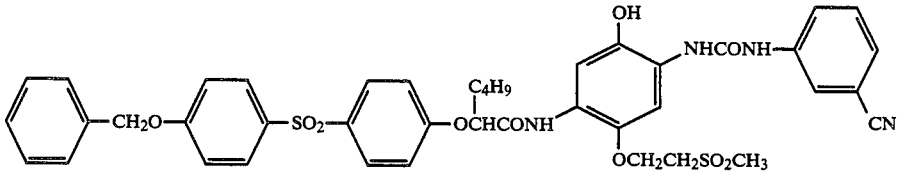

-continued
(I-21)
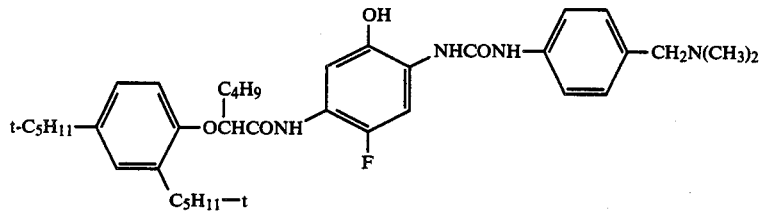
(I-22)
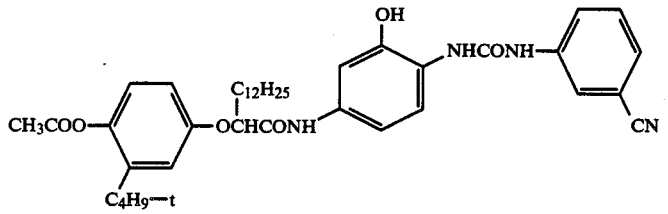
(I-23)
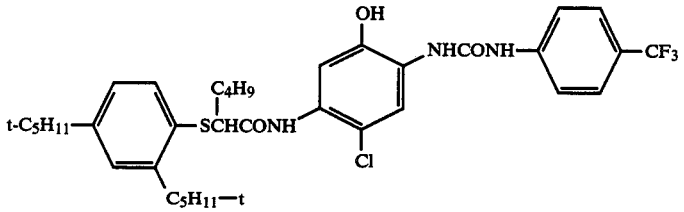
(I-24)
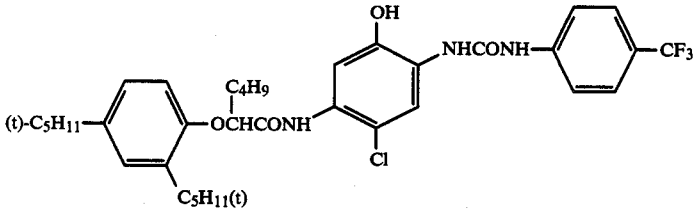
(I-25)
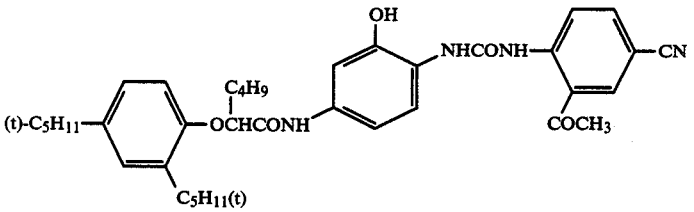
(I-26)
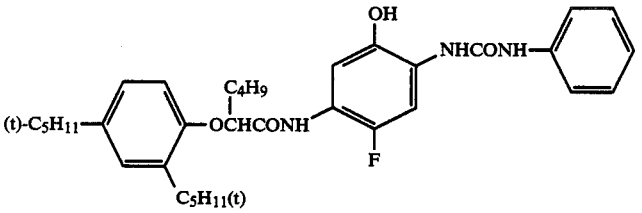
(I-27)
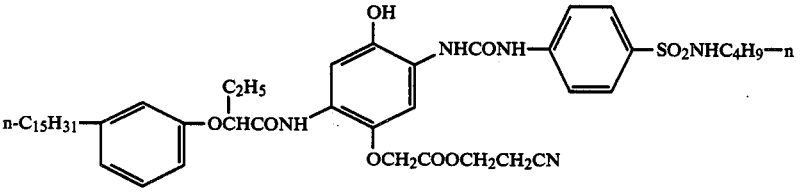

-continued
(I-28)
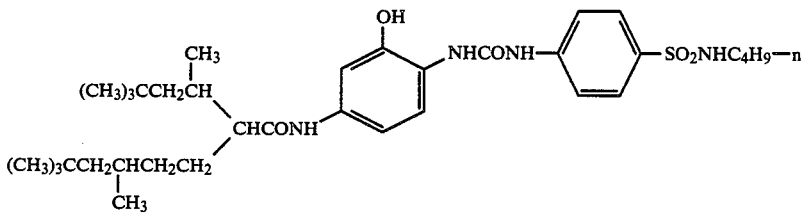
(I-29)
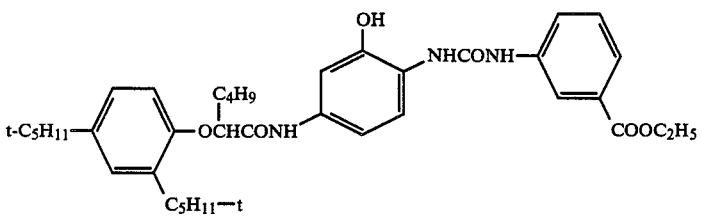
(I-30)
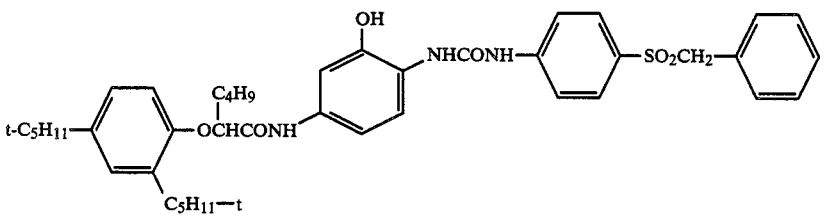
(I-31)
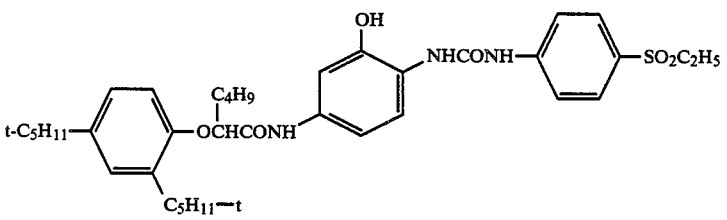
(I-32)
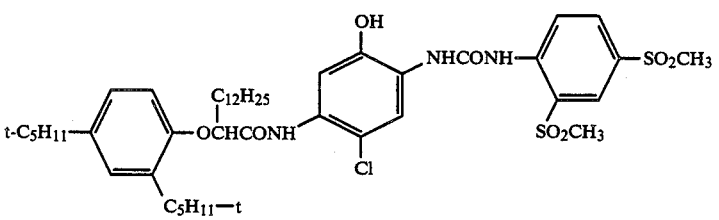
(I-33)
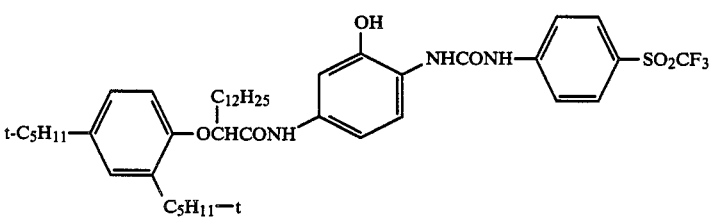
(I-34)
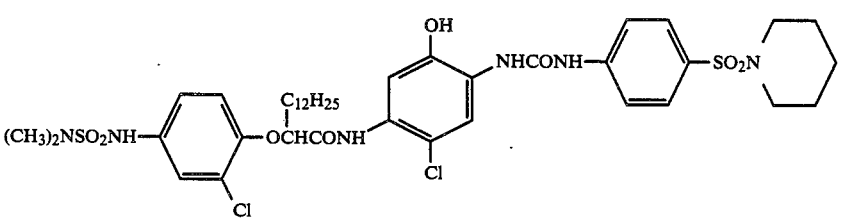

-continued
(I-35)
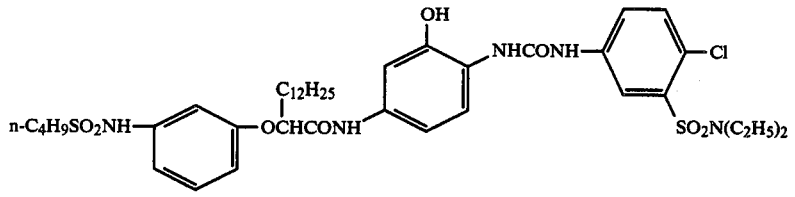
(I-36)
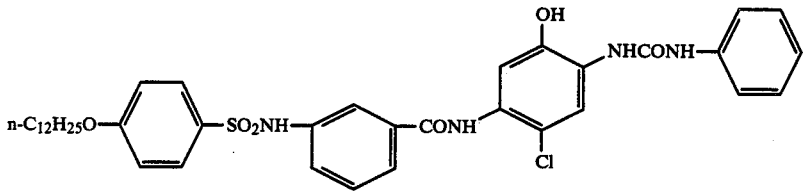
(I-37)
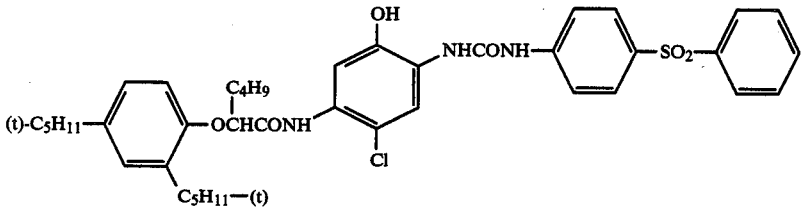
(I-38)
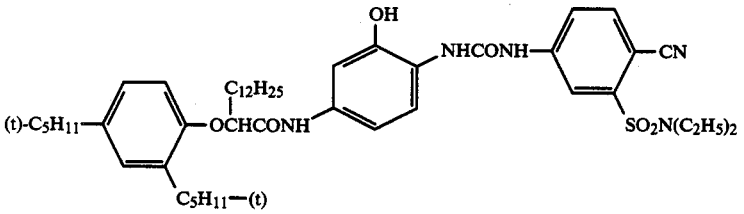
(I-39)
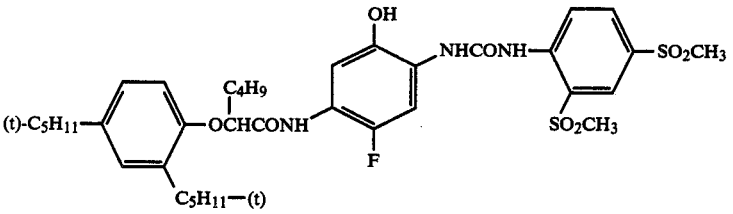
(I-40)
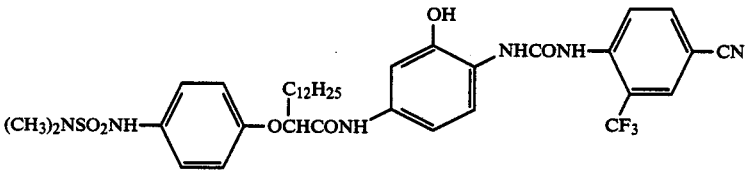
(I-41)
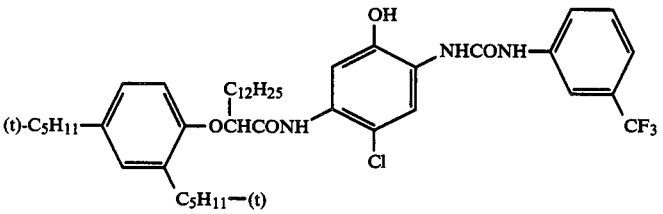

-continued
(I-42)
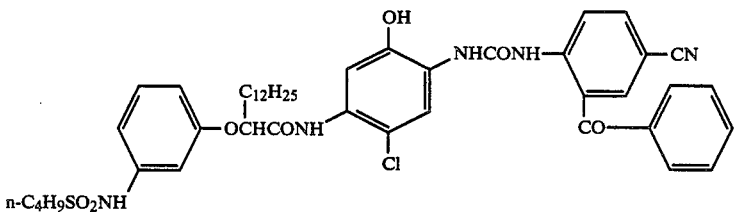
(I-43)
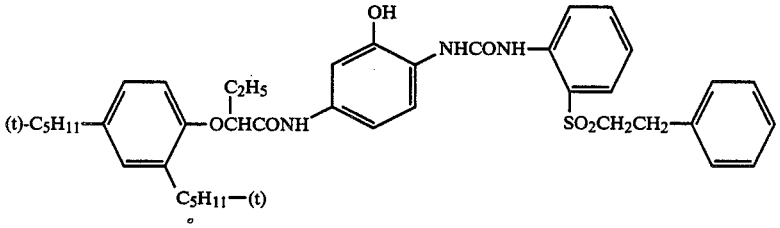
(I-44)
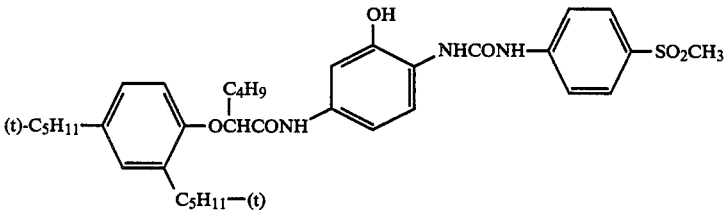
(I-45)
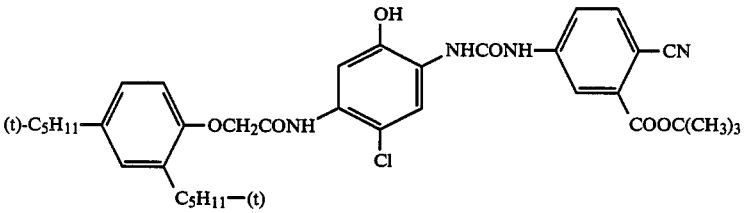
(I-46)
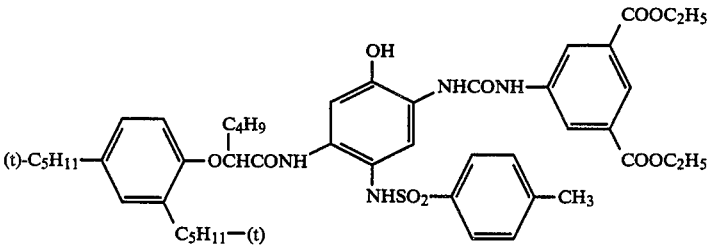
(I-47)
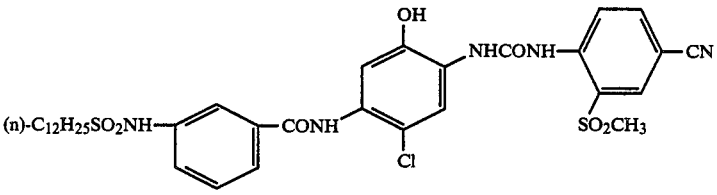
(I-48)
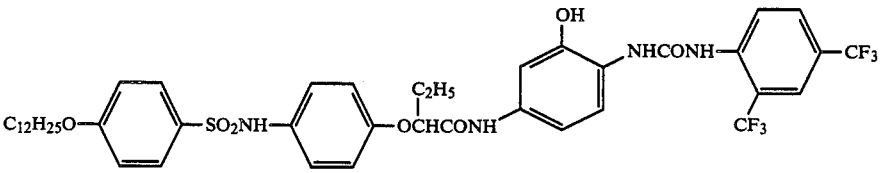

-continued (I-49)

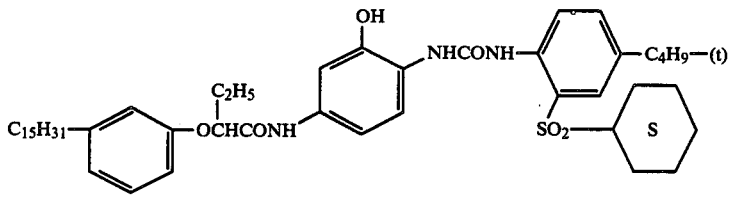

(I-50)

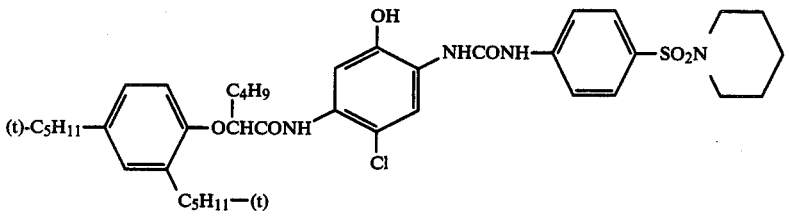

(I-51)

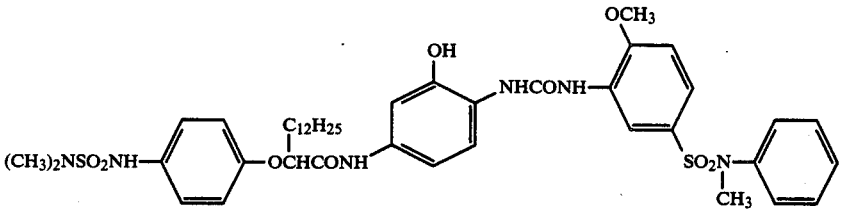

(I-52)

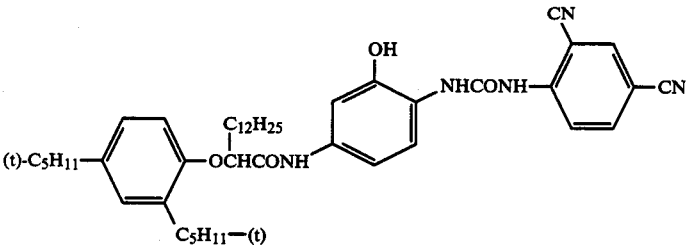

(I-53)

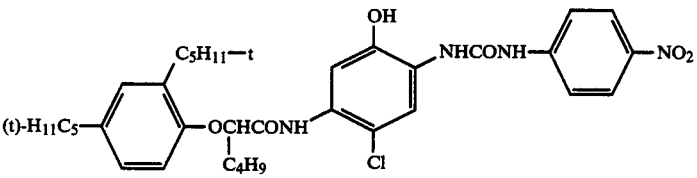

(I-54)

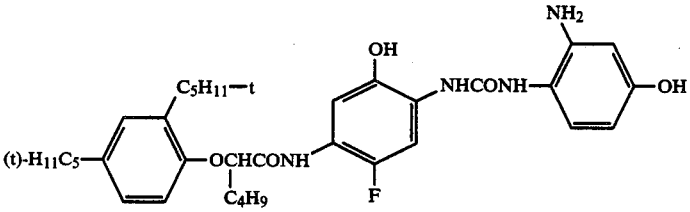

(I-55)

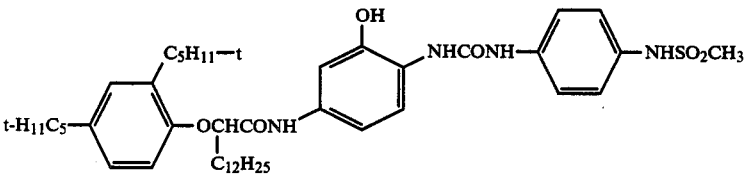

Next, those naphthol-type cyan couplers having the foregoing Formula [II] are illustrated below:

Those couplers having Formula [II] are substantially colorless compounds, and the being colorless means that the spectral absorption coefficient ($\epsilon$) in the absorption maximum ($\lambda$max) of the coupler in the region of visible rays is not more than 5000. Namely, colored couplers, for example, those colored couplers as described in U.S. Pat. No. 3,476,563 and the like are not to be included in the naphthol-type cyan couplers of the present invention. The reason is that these colored couplers are practically used as the material for use in the so-called masking method for the purpose of improving the color reproduction in color negative light-sensitive materials, but if the coupler is added in such a quantity as to give the optimal masking effect, the objective effect of the present invention could be hardly attained, and if, on the other hand, added in such a quantity as to attain the objective effect of the present invention, the color or light-sensitive material would become unnecessarily dyed, and thus it is totally impractical.

In Formula [II], the ballasting group represented by $R_3$ is an aliphatic, an aromatic or a heterocyclic group. The aliphatic group may be either a saturated or unsaturated group, or any one of straight-chain, branched-chain and cyclic groups, such as, for example, an alkyl group (such as, e.g., t-butyl, n-octyl, t-octyl, n-dodecyl, etc.), a cycloalkyl group (such as cyclohexyl), an alkenyl group (such as lauryl), and the like. These groups each may have a substituent. The aromatic group is typified by aryl groups (such as phenyl, naphthyl, etc.). The heterocyclic group is typified by pyridyl, quinolyl, piperidyl, imidazolyl, and the like groups, and these groups each may have a substituent; preferably an alkyl, phenyl or a group having Formula [Ic]. The substituent introducible into the aliphatic or aromatic group, or heterocyclic residue represented by $R_3$ is a halogen atom or such a group as nitro, hydroxyl, carboxy, amino, sulfo, an alkyl, an alkenyl, an aryl, a heterocyclic residue, an alkoxy, an aryloxy, an arylthio, an arylazo, an acylamino, carbamoyl, an ester, an acyl, an acyloxy, sulfonamido, sulfamoyl, sulfonyl, morpholino, piperazyl, imidazolyl, or the like.

The ballasting group represented by $R_3$ may be additionally substituted with not less than one coupler residue. Namely, there may be not less than two coupler residues in the coupler molecule having Formula [II].

The split-off group represented by $X_2$ includes those split-off groups represented by $X_1$ in Formula [I]. In addition, the split-off group, after being split-off, is not allowed to affect a silver halide to inhibit the development thereof. The so-called development inhibitor releasing-type couplers (hereinafter referred to as "DIR coupler") as described in, for example, U.S. Pat. No. 3,227,554 and Japanese Patent O.P.I. Publication No. 77635/1974, and the like, and those compounds which, after being split off, have a timing group to release a development inhibitor (hereinafter referred to as "timing DIR coupler") as described in U.S. Pat. No. 4,248,962 and the like, are not included in the naphthol-type cyan couplers of the present invention. It is because the addition of the DIR coupler or timing DIR coupler in such an amount as to give the optimal development inhibiting effect will carry out little or no intended effect of the invention, while on the other hand an increase in the adding amount in order to obtain the intended effect of the invention will too much inhibit the development to produce a sufficient cyan image density.

In the present invention, $X_2$ should preferably be a split-off group to combine with a coupler residue by a hydrogen atom or an oxygen atom.

More preferably, $X_2$ is desirable to be a hydrogen atom or a group having the following Formula [IIa]:

$$-O-R_7-Z_2-R_8 \qquad \text{Formula [IIa]}$$

wherein $R_7$ represents a saturated or unsaturated divalent aliphatic group or divalent aromatic group, which is allowed to be further substituted with another substituents; $Z_2$ represents $$-\overset{\overset{R_9}{|}}{CON}-,\ -\overset{\overset{R_9}{|}}{SO_2N}-,$$

—NHCO—, —SO—, —$SO_2$—, —$NHSO_2$—, —CO—, —COO—, —S—, —O—, or a mere bonding hand; and $R_8$ and $R_9$ each is a hydrogen atom or an aliphatic group, an aromatic group or a heterocyclic group, provided that those groups having Formula [IIa] are ones which, after being split off, have no development inhibiting effect.

To be concrete, the divalent aliphatic group represented by $R_7$ includes such alkylenes as, e.g., methylene, dimethylene, trimethylene, 2-methyl-dimethylene, 2-methyl-trimethylene, and the like. The divalent aliphatic group may be in the form of a branched chain, and may be further substituted with a different substituent (such as a halogen atom or an aryl group) than the $-Z_2-R_8$.

And the divalent aromatic group represented by $R_7$ includes such arylene groups as 1,2-phenylene, 1,4-phenylene, 1,3-phenylene, 1,5-naphthylene, and the like, and such a heterocyclic group as 2,5-pyridylene, and these each may be substituted with a different group (such as a chlorine atom or an aliphatic group) than the $-Z-R_8$.

Further, the aliphatic group represented by each of $R_8$ and $R_9$ is allowed to be either saturated or unsaturated, and to be in the form of a straight chain, branched chain or any cyclic ring, and is typified by alkyl and alkenyl groups, preferred examples of which include methyl, ethyl, isobutyl, octyl, t-octyl, octadecyl, cyclobutyl, cyclohexyl, 2-norbornyl and the like groups. The aromatic group is typified by aryl groups, preferably phenyl group, naphthyl group, and the like. The heterocyclic residue is preferably the residue of a 5- or 6-member heterocyclic ring containing such hetero atoms as nitrogen, sulfur, oxygen, etc., preferred examples of which include, e.g., thienyl, pyridinyl, quinolyl, oxadiazolyl, and the like groups, and these each may have a substituent. These groups, however, after $X_2$ is split off, release no development inhibitor.

The substituent to substitute the aliphatic group, aromatic group or heterocyclic group represented by each of $R_8$ and $R_9$ includes a halogen atom (fluorine, chlorine or bromine), nitro, cyano, hydroxy, alkoxy, acyloxy, acylamino, sulfonamido, sulfamoyl, sulfonyl, carboxy, sulfo, and the like groups, but different other substituents may also be used.

The substituent or $R_8$ and $R_9$ may also be a coupler residue through $-Z'-R_7-O-$ where $Z'$ and $R_7$ are as defined in the foregoing $Z'$ and $R_7$; that is, not less than two coupler residues are allowed to be present in the coupler molecule having Formula [II].

As $X_2$ more preferred split-off groups are those having the following Formula [IIb]:

$$-O-(CH_2)_n-Z_3-R_8 \qquad \text{Formula [IIb]}$$

wherein n is an integer of from 1 to 3; $Z_3$ is $$-\overset{\overset{R_9}{|}}{CON}-,$$

—COO—, —CO—, or —$SO_2$—; and $R_8$ and $R_9$ are as defined in the $R_8$ and the $R_9$ of Formula [IIa].
The following are examples of the preferred compounds of the present invention, but the present invention is not limited thereto.
Exemplified Compounds:
(II-1)
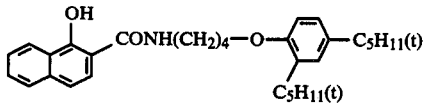
(II-2)
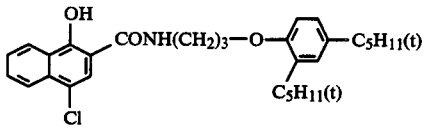
(II-3)
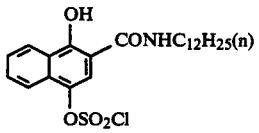
(II-4)
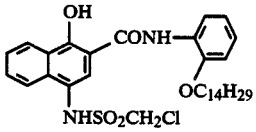
(II-5)
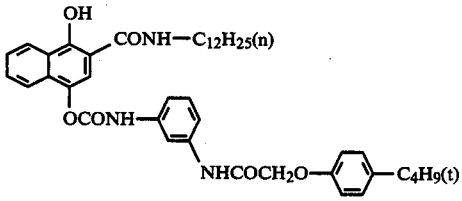
(II-6)
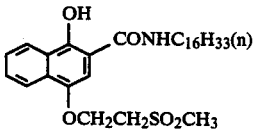
(II-7)
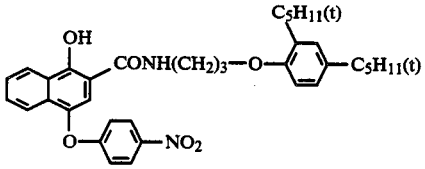
(II-8)
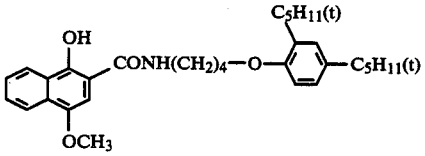
(II-9)
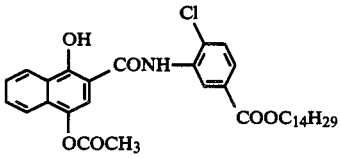
-continued
Exemplified Compounds:
(II-10)
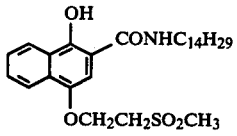
(II-11)
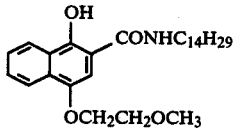
(II-12)
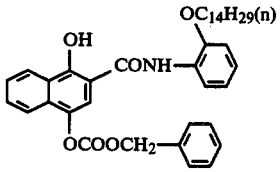
(II-13)
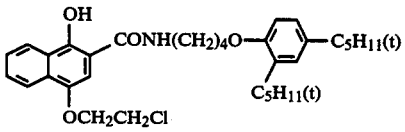
(II-14)
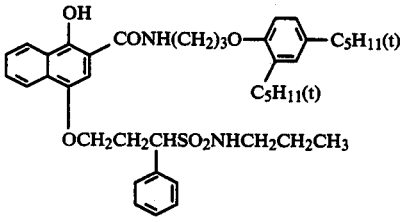
(II-15)
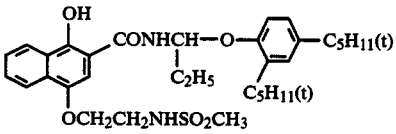
(II-16)
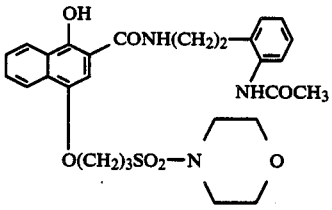
(II-17)
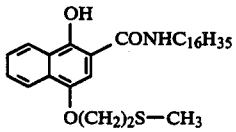
(II-18)
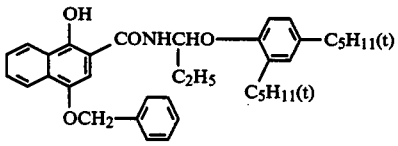
(II-19)
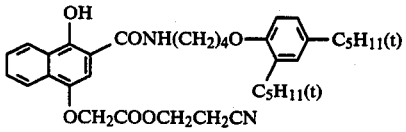

-continued
Exemplified Compounds:
(II-20)
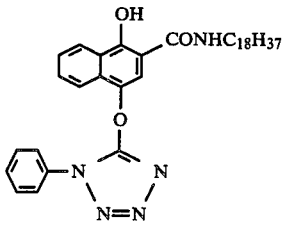
(II-21)
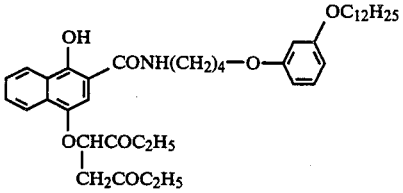
(II-22)
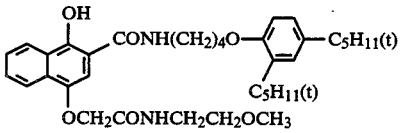
(II-23)
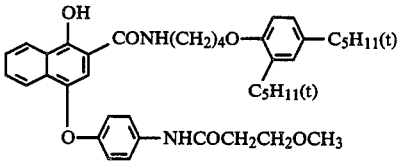
(II-24)
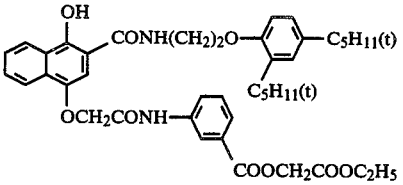
(II-25)
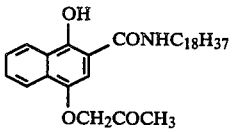
(II-26)
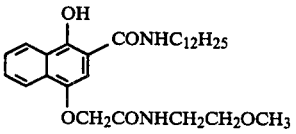
(II-27)
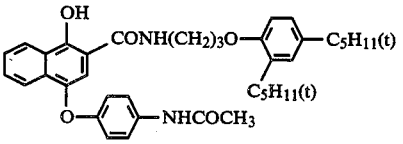
(II-28)
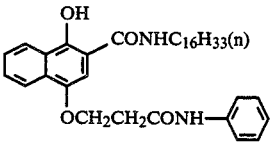
-continued
Exemplified Compounds:
(II-29)
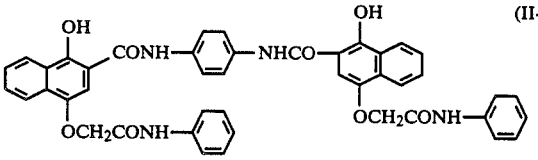
(II-30)
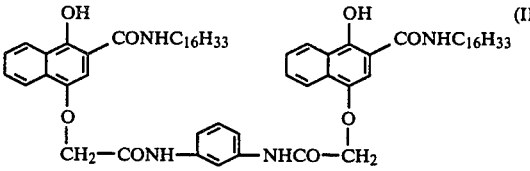
(II-31)
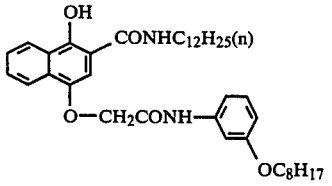
(II-32)
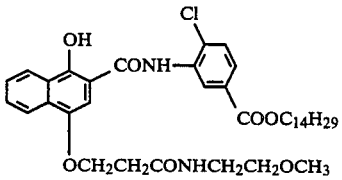
(II-33)
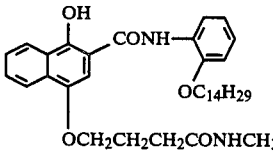
(II-34)
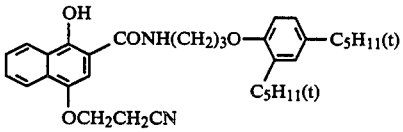
(II-35)
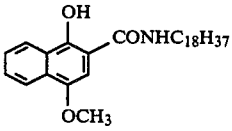
(II-36)
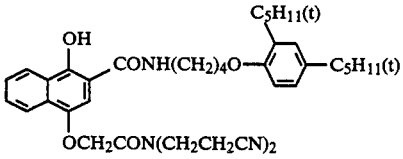
(II-37)
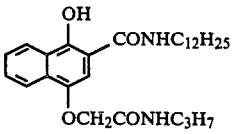
(II-38)
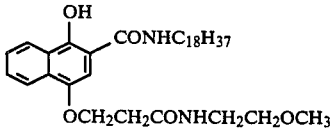

-continued
Exemplified Compounds:
(II-39)
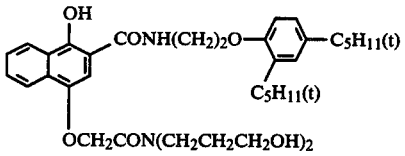
(II-40)
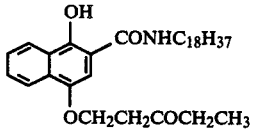
(II-41)
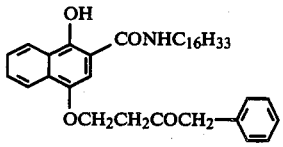
(II-42)
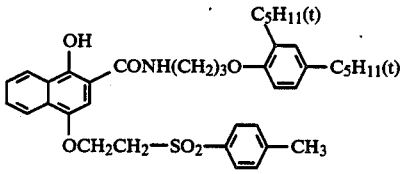
(II-43)
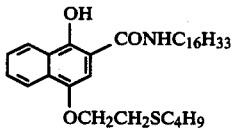
(II-44)
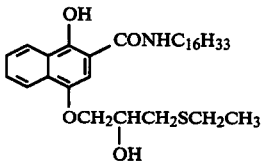
(II-45)
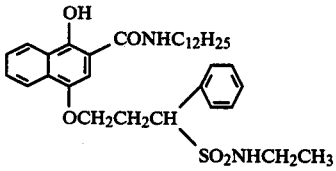
(II-46)
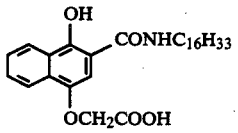
(II-47)
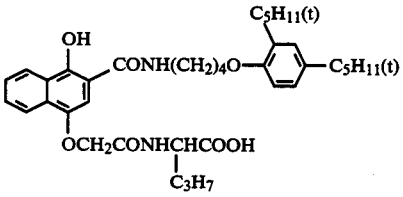
(II-48)
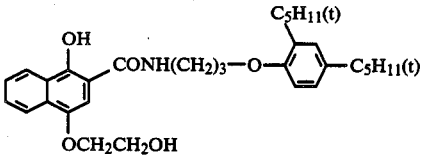
-continued
Exemplified Compounds:
(II-49)
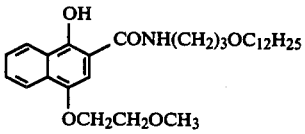
(II-50)
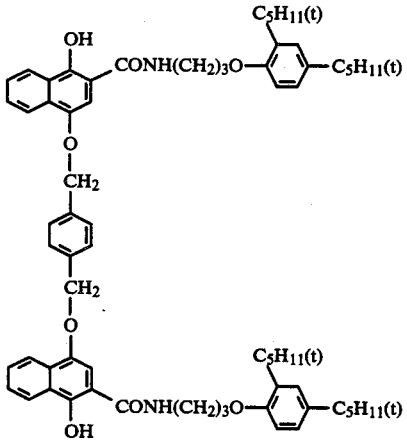
(II-51)
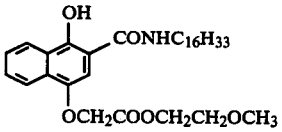
(II-52)
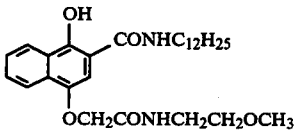
(II-53)
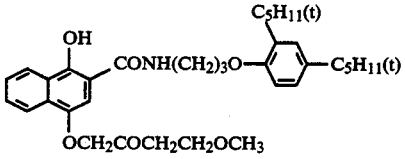
(II-54)
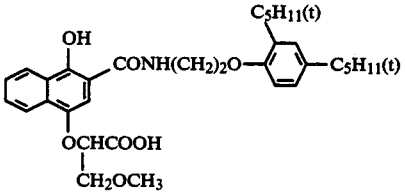
(II-55)
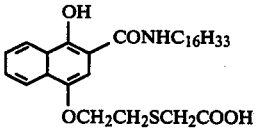
(II-56)
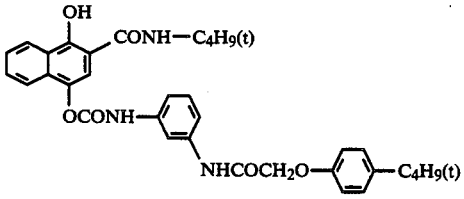

-continued

Exemplified Compounds:

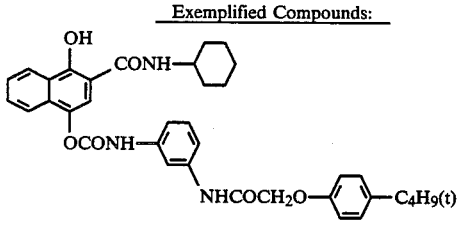

(II-57)

Any of the naphthol-type cyan couplers of the present invention can be synthesized by known methods, for example, by the method as described in the Journal of the American Chemical Society Vol. 64, p. 798 (1942), or by the methods as described in the reference publications cited in the illustration of $X_1$, the split-off group in Formula [I].

In the silver halide color photographic light-sensitive material of the present invention, the light-sensitive silver halide emulsions are coated on the support, in the form of a plurality of layers respectively having the different wavelength regions from each other layer, and the light-sensitive silver halide emulsion layer may be either a single layer or a group of not less than two emulsion layers which are sensitive to the same wavelength region but different in the speed. If the light-sensitive silver halide emulsion layer consists of not less than two emulsion layers, these emulsion layers may be either contiguous to each other or spaced apart with a different light-sensitive silver halide emulsion layer sensitive to a different wavelength region, a nonlight-sensitive hydrophilic colloidal layer, or a layer having different purposes therebetween.

The nonlight-sensitive hydrophilic colloidal layer includes, e.g., an interlayer, antihalation layer, yellow colloidal layer and protective layer.

The ureido-substituted phenol-type cyan coupler of the present invention is added to the silver halide emulsion normally in a quantity of from 0.01 to 2 moles, and preferably from 0.03 to 0.5 mole per mole of silver halide.

If at least one layer of the silver halide emulsion layers of the present invention is composed of not less than two same color sensitivity-having emulsion layers, the speeds of the respective emulsion layers may be the same, or the layer located farther from the support may be a higher-speed emulsion layer and the layer located near the support may be a lower-speed emulsion layer. In this instance, the ureido-substituted phenol-type cyan coupler and the naphthol-type cyan coupler of the present invention are allowed to be added to any of the emulsion layers, but a preferred instance is such that the naphthol-type cyan coupler is incorporated into the higher-speed emulsion layer, and the ureido-substituted phenol-type cyan coupler into the lower-speed emulsion layer, and a more preferred instance is such that the foregoing naphthol-type cyan coupler is a two-equivalent coupler having the substituent at the active site thereof.

The naphthol-type cyan coupler of the present invention should be added in a quantity of from 0.05 to 1 mole, and preferably from 0.15 to 0.5 mole per mole of the ureido-substituted phenol-type cyan coupler contained in the entire silver halide light-sensitive material.

The ureido-substituted phenol-type cyan coupler and the naphthol-type cyan coupler of the present invention may be dissolved in a high boiling solvent and dispersed to be added to the silver halide emulsion in such the manner as described in U.S. Pat. No. 2,322,027, and may also be dissolved in an alkaline aqueous solution or in a hydrophilic organic solvent (such as methanol, ethanol, acetone, etc.) to be added, but in the case of adding the ureido-substituted phenol-type cyan coupler, the coupler is desirable to be dissolved in an alkyl ester of phthalic acid (such as dibutyl phthalate).

The cyan couplers of the present invention may be used together with a colorless coupler, colored coupler, or DIR compound and may be emulsified to be mixed with them into one emulsion, which may be then added to the silver halide emulsion, or each may be added as an independent emulsion.

The compounds having Formulas [I] and [II] of the present invention may be applied to various silver halide photographic light-sensitive materials. For example, the compounds are useful for any of the light-sensitive materials for black-and-white use, color use and false color use, and may be applied to silver halide photographic light-sensitive materials for such various uses as general black-and-white use, black-and-white graphic arts use, X-ray use, electron beam recording use, high resolution black-and-white use, general color use, color X-ray use, diffusion transfer-type color use, and the like.

To the silver halide color photographic light-sensitive material of the present invention may be applied known 2-equivalent and 4-equivalent couplers.

As the yellow coupler to be used in the present invention, open-chain ketomethylene compounds such as, e.g., pivalyl acetanilide-type and benzoyl acetanilide-type yellow couplers may be used.

As the magenta coupler, pyrazolone-type, pyrazolotriazole-type, pyrazolinobenzimidazole-type and indazolone-type compounds may be used.

As the colored magenta coupler as a masking coupler, a compound produced by substituting an arylazo group at the active site of the colorless magenta coupler is generally used.

Further, there may also be used a colored magenta coupler of the type that the dye thereof flows into the processing bath during the reaction with the oxidized product of a color developing agent.

As the colored cyan coupler as a masking coupler, a compound produced by substituting an arylazo group at the active site of the colorless cyan coupler is generally used. Further there may also be used a colored cyan coupler of the type that the dye thereof flows into the processing bath during the reaction with the oxidized product of a color developing agent.

In order to improve the photographic characteristics, such a coupler as to form a colorless dye, the so-called competing coupler, may also be incorporated.

The preferred couplers used in the present invention are those 2-equivalent couplers as described on pp. 68 to 80 of Japanese Patent O.P.I. Publication No. 144727/1978 and those 4-equivalent couplers as described on pp. 109 to 115 of the same publication or colored couplers.

The emulsion layers or nonlight-sensitive colloidal layers of the silver halide color photographic light-sensitive material of the present invention may contain a reducing agent or oxidation inhibitor, for example, a sulfite such as sodium sulfite, potassium sulfite, etc., a hydrogensulfite such as sodium hydrogensulfite, potassium hydrogensulfite, etc., a hydroxylamine such as hydroxylamine, N-methyl-hydroxylamine, N-phenyl-hydroxylamine, etc., a sulfinic acid such as sodium phenyl-sulfinate, etc., a hydrazine such as N,N'-dimethyl hydrazine, etc., a reductone such as ascorbic acid, etc., an aromatic hydrocarbon having not less than one hydroxyl group, such as p-aminophenol, alkyl hydroquinone, gallic acid, catechol, pyrogallol, resorcinol, 2,3-dihydroxynaphthalene, etc., and the like.

In order to further improve the light resistance of the magenta image formed from the magenta coupler of the present invention, to the emulsion layer or a layer adjacent thereto may be added a p-alkoxyphenol and a phenolic compound.

The layer construction of the silver halide color photographic light-sensitive material of the present invention may be in accordance with an ordinary subtractive color process, and as a rule, the construction is basically composed of three layers: the blue-sensitive emulsion layer containing an yellow coupler for the formation of a yellow dye, the green-sensitive emulsion layer containing a magenta coupler for the formation of a magenta dye, and the red-sensitive emulsion layer containing a cyan coupler for the formation of a cyan dye. Further, any one of or each of all the layers may be coated in the form of double or triple layers to thereby improve such photographic characteristics as the color developability, color reproducibility, formed dye's graininess, and the like, of the light-sensitive material.

Aside from these basic emulsion layers, a protective layer as the topmost layer, interlayers and filter layers between the emulsion layers, and a subbing layer and antihalation layer as the bottom layer may be appropriately used to thereby effect protection of the layers, prevention of color stain, and improve the graininess, color reproduction and layer adhesion, and the like.

The silver halide usable in the silver halide color photographic light-sensitive material of the present invention includes arbitrary silver halides usually used in ordinary silver halide photographic light-sensitive materials, such as silver chloride, silver bromide, silver iodide, silver chlorobromide, silver iodobromide, silver chloroiodide, and the like.

The above-described silver halde emulsions may be sensitized by use of known chemical sensitizers. As the chemical sensitizer, noble metallic sensitizers, sulfur sensitizers, selenium sensitizers and reduction sensitizers may be used singly or in combination.

As the binder for the silver halide, any known binders may be used. Further, the silver halide to be used in the present invention, if necessary, be spectrally sensitized by use of known sensitizing dyes.

To the above silver halide emulsions, in order to prevent possible deterioration of the speed or possible occurrence of fog during the manufacture, storage, or processing of the color light-sensitive material, may be added various compounds including such a heterocyclic compound as 1-phenyl-5-mercaptotetrazole, 3-methyl-benzothiazole, 4-hydroxy-6-methyl-1,3,3a,7-tetrazaindene, or the like, mercapto compounds, metallic salts, and the like.

The hardening of these emulsions may be effected in a normal manner.

To the above-mentioned silver halide emulsions may be added surface active agents singly or in a mixture. Various surface active agents may be used as a coating aid, emulsifying agent, agent for improving the permeability into a processing liquid, defoaming agent, antistatic agent, antiadhesive, or for improving the photographic characteristics or for controlling the physical properties.

The color developer for use in the processing of the silver halide color photographic light-sensitive material of the present invention is a developing agent-containing alkaline aqueous solution having a pH of not less than 8, preferably a pH of from 9 to 12.

An aromatic primary amine developing agent as the developing agent means a compound having primary amino group on the aromatic cyclic ring and is capable of developing the exposed silver halide, or a precursor that forms such a compound.

The above-mentioned developing agent is typified by p-phenylenediamine type compounds, and the preferred examples thereof include 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethyl-4-amino-N,N-diethylaniline, 3-methoxy-4-amino-N-ethyl-N-β-hydroxyethylaniline, 3-methoxy-4-amino-N-ethyl-N-β-methoxyethylaniline, 3-acetamido-4-amino-N,N-diethylaniline, 4-amino-N,N-dimethylaniline, N-ethyl-N-β-[β-(β-methoxyethoxy)ethoxy]ethyl-3-methyl-4-aminoaniline, N-ethyl-N-β-(β-methoxyethoxy)-ethyl-3-methyl-4-aminoaniline, and salts of these compounds such as, e.g., sulfates, hydrochlorides, sulfites, p-toluenesulfonates, and the like. And to a color developer containing any of these developing agent may, if necessary, be added various additives.

The color photographic light-sensitive material of the present invention is imagewise exposed and color-developed, and after that, may be subjected to a bleaching in a usual manner. This bleaching may be effected either concurrently with fixing or separately from fixing. The bleaching bath, by adding a fixer thereto, may be used as a bleach-fix bath. As the bleaching agent, various compounds may be used, and to the bleaching bath may be added a bleaching accelerator and various other additives.

The present invention may be realized in various types of silver halide color photographic light-sensitive material. One type is such that a photographic light-sensitive material having on the support thereof a silver halide emulsion layer containing a nondiffusible coupler is processed in an alkaline developer liquid containing an aromatic primary amine color developing agent to thereby cause the produced water-insoluble or nondiffusible dye to remain in the emulsion layer. Another type is such that a photographic light-sensitive material having on the support thereof a silver halide emulsion layer in combination with a nondiffusible coupler is processed in an alkaline developer solution containing an aromatic primary amine color developing agent to render the formed dye water-soluble to thereby produce a diffusible dye, which dye is then transferred onto an image receiving layer composed of a hydrophilic colloid; that is, the diffusion transfer color process.

The silver halide color photographic light-sensitive material of the present invention includes color negative film, color positive film, color photographic film, color paper, and all other equivalent silver halide color photographic light-sensitive materials.

The preferred embodiments of the present invention include:

1. a silver halide color photographic light-sensitive material containing in at least one red-sensitive silver halide emulsion layer thereof couplers having Formula [I] and Formula [II] as defined in claim 2, 2. a silver halide color photographic light-sensitive material containing in the red-sensitive high-speed silver halide emulsion layer thereof at least one coupler having Formula [II] as defined in claim 2, the $X_2$ of which formula has the foregoing Formula [IIa], 3. a silver halide color photographic light-sensitive material containing in the red-sensitive low-speed silver halide emulsion layer thereof at least one coupler having Formula [II] as defined in claim 2, the $X_2$ of which formula is a hydrogen atom, 4. a silver halide color photographic light-sensitive material containing in the red-sensitive high-speed silver halide emulsion layer thereof at least one coupler having Formula [II] as defined in claim 2, the $X_2$ of which formula has the foregoing Formula [IIb], 5. a silver halide color photographic light-sensitive material according to embodiment 2 or 4 wherein the red-sensitive high speed silver halide emulsion layer contains a coupler having Formula [I] as defined in claim 1 in a quantity of from 0 to 1 mole per mole of the coupler having Formula [II], and the whole red-sensitive silver halide emulsion layers contain the coupler having Formula [II] in a quantity of from 0.05 to 0.5 mole per mole of the coupler having Formula [I], 6. a silver halide color photographic light-sensitive material according to embodiment 3 wherein the red-sensitive low-speed silver halide emulsion layer contains the coupler having Formula [II] as defined in claim 2 in a quantity of from 0 to 0.4 mole per mole of the coupler having Formula [I], and the whole red-sensitive silver halide emulsion layers contain the coupler having Formula [II] in a quantity of from 0.05 to 0.5 mole per mole of the coupler having Formula [I], and the like.

The present invention will be illustrated in detail with reference to examples below, but the embodiments of the present invention are not limited thereto.

EXAMPLE 1

0.1 mole per mole of Ag of each of the ureido-substituted phenol-type couplers and comparative couplers as shown in Table 1 was taken. To these couplers were added additional couplers as shown in Table 1 in the amounts given in Table 1, respectively, to each of which coupler mixtures was added a mixture liquid of dibutyl phthalate in an amount one half the weight of the couplers used with ethyl acetate in an amount three times the weight of the same, and the resulting mixture was heated to 60° C. to be dissolved completely. This solution was mixed with 200 ml of aqueous 5% solution of Alkanol B (alkylnaphthalene sulfonate, produced by DuPont) and emulsified to be dispersed to thereby obtain an emulsion. After that, the dispersed liquid was added to 1 kg of a red-sensitive silver iodobromide emulsion (containing 6 mole% silver iodobromide), to which was then further added 20 ml of 2% solution (water:methanol=1:1) of 1,2-bis(vinyl-sulfonyl)ethane as a hardener. The thus prepared emulsion was coated on a subbed transparent polyester base and then dried, whereby samples (1-1) to (1-16) were prepared. (The coated amount of coupler: $2.1\times10^{-5}$ mol/100 cm$^2$).

The thus obtained samples each was exposed through a wedge to light in the ordinary sensitometeric manner, and then processed in accordance with the following procedures for the development process:

| Processing steps (38° C.) | Processing time |
|---|---|
| Color development | 3 min. 15 sec. |
| Bleaching | 1 min. 30 sec. |
| Washing | 3 min. 15 sec. |
| Fixing | 6 min. 30 sec. |
| Washing | 3 min. 15 sec. |
| Stabilizing bath | 1 min. 30 sec. |

The compositions of the processing liquids used in the development process are as follows:

| | |
|---|---|
| Color Developer Composition: | |
| 4-amino-3-methyl-N—ethyl-N—(β-hydroxyethyl)-aniline sulfate | 4.75 g |
| Anhydrous sodium sulfite | 4.25 g |
| Hydroxyamine ½ sulfate | 2.0 g |
| Anhydrous potassium carbonate | 37.5 g |
| Sodium bromide | 1.3 g |
| Trisodium nitrilotriacetate, monohydrated | 2.5 g |
| Potassium hydroxide | 1.0 g |
| Water to make 1 liter | |
| Use potassium hydroxide to adjust the pH to 10. | |
| Bleaching Bath Composition: | |
| Iron-ammonium ethylenediaminetetraacetate | 100.0 g |
| Diammonium ethylenediaminetetraacetate | 10.0 g |
| Ammonium bromide | |
| Glacial acetic acid | |
| Water to make 1 liter | |
| Use aqueous ammonia to adjust the pH to 6.0 | |
| Fixing Bath Composition: | |
| Ammonium thiosulfate (50% aqueous solution) | 162 ml |
| Anhydrous sodium sulfite | 12.4 g |
| Water to make 1 liter | |
| Use acetic acid to adjust the pH to 6.5 | |
| Stabilizing Bath Composition: | |
| Formalin (37% aqueous solution) | 5.0 ml |
| Koniducks (produced by Konishiroku Photo Industry Co., Ltd.) | 7.5 ml |
| Water to make 1 liter | |

In addition, the $\lambda_{max}^{2.0}$, $\lambda_{max}^{0.5}$, $\Delta\lambda$max, and $\lambda_s^{0.5}$ in Table 1 are to be defined as follows:

$\lambda_{max}^{2.0}$: In the spectral region, the absorption maximum wavelength (nm) when the density in the absorption maximum is 2.0.

$\lambda_{max}^{0.5}$: In the spectral region, the absorption maximum wavelength (nm) when the density in the absorption maximum is 0.5.

$\Delta\lambda$max: $\lambda_{max}^{2.0}-\lambda_{max}^{0.5}$ $\lambda$s: The wavelength (nm) where the density on the shorter wavelength side becomes 0.1 when the density in the absorption maximum is 0.5.

As to the $\lambda_{max}^{2.0}$ and $\lambda_{max}^{0.5}$, the longer the wavelength the better. Also in the $\lambda_s^{0.5}$, the longer the wavelength the better sharp-cut the toe on the shorter wavelength side and the less the sub-absorption in the green region. And the $\Delta\lambda$max represents the changeable range according to the change in the color density, and the smaller the change the better.

The adding amount is expressed in a molar quantity per mole of silver halide.

TABLE 1

| Sample No. | Coupler | Additional coupler | $\lambda_{max}^{2.0}$ | $\lambda_{max}^{0.5}$ | $\Delta\lambda$max | $\lambda_s^{0.5}$ | Adding amount | Remarks |
|---|---|---|---|---|---|---|---|---|
| 1-1 | Exemplified compound (I-44) | — | 696 | 682 | 14 | 548 | — | comparative |
| 1-2 | Exemplified | Exemplified | 697 | 692 | 5 | 560 | 0.025 | invention |

TABLE 1-continued

| Sample No. | Coupler | Additional coupler | $\lambda^{2.0}_{max}$ | $\lambda^{0.5}_{max}$ | Δλmax | $\lambda^{0.5}_{s}$ | Adding amount | Remarks |
|---|---|---|---|---|---|---|---|---|
| | compound (I-44) | compound (II-6) | | | | | | |
| 1-3 | Exemplified compound (I-44) | Exemplified compound (II-22) | 699 | 699 | 0 | 564 | " | " |
| 1-4 | Exemplified compound (I-44) | Exemplified compound (II-36) | 696 | 693 | 3 | 561 | " | " |
| 1-5 | Exemplified compound (I-44) | Exemplified compound (II-25) | 697 | 694 | 3 | 561 | " | " |
| 1-6 | Exemplified compound (I-44) | Exemplified compound (II-19) | 698 | 694 | 4 | 561 | " | " |
| 1-7 | Exemplified compound (I-44) | Comparative coupler [A] | 690 | 675 | 15 | 543 | " | comparative |
| 1-8 | Exemplified compound (I-44) | Comparative coupler [B] | 689 | 675 | 14 | 542 | " | " |
| 1-9 | Exemplified compound (I-44) | Comparative coupler [D] | 696 | 684 | 12 | * | 0.007 | " |
| 1-10 | Exemplified compound (I-44) | Comparative coupler [E] | 696 | 683 | 13 | 548 | 0.002 | " |
| 1-11 | Exemplified compound (I-44) | Comparative coupler [F] | 696 | 682 | 14 | 548 | 0.005 | " |
| 1-12 | Comparative coupler [A] | — | 662 | 666 | −4 | 557 | — | " |
| 1-13 | Comparative coupler [B] | — | 670 | 675 | −5 | 560 | — | " |
| 1-14 | Comparative coupler [C] | — | 650 | 653 | −3 | 545 | — | " |
| 1-15 | Exemplified compound (II-1) | — | 696 | 700 | −4 | 573 | — | " |
| 1-16 | Exemplified compound (II-22) | — | 694 | 695 | −1 | 570 | — | " |

Note:
*Measurement was impossible

Comparative coupler [A]

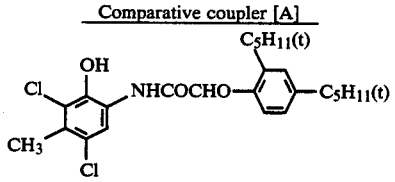

Comparative coupler [B]

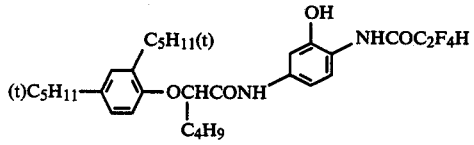

Comparative coupler [C]

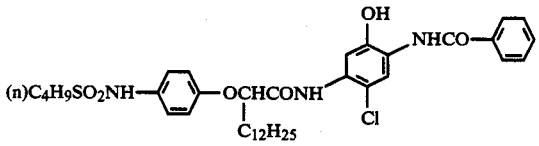

Comparative coupler [D]

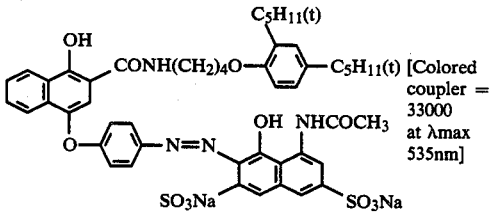

[Colored coupler = 33000 at λmax 535nm]

Comparative coupler [E]

-continued

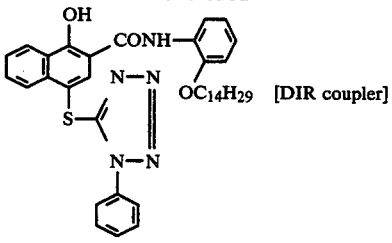

[DIR coupler]

Comparative coupler [F]

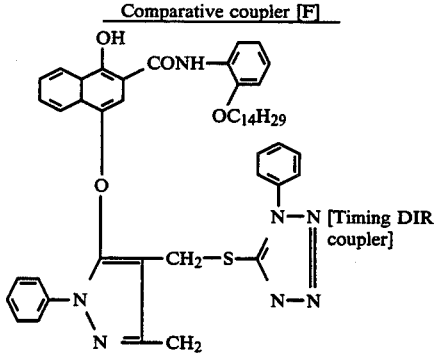

[Timing DIR coupler]

From the results shown in Table 1, it is apparent that when the ureido-substituted phenol-type coupler of the present invention is independently used, the λmax changes according to density; in the lower density area the λmax is on the shorter wavelength side, while when the same coupler is used together with the naphthol-type coupler of the invention, the change in the λmax becomes surprisingly smaller or no change occurs at all; even in the low density area the λmax is in the sufficiently longer wavelength region.

On the other hand, the combined use with different couplers (comparative couplers [A] and [B]) than those of the present invention produces no such effect as the above, and on the contrary, can cause reverse effect with the Δλmax changing to become larger.

Alternatively, even if a colored coupler (comparative coupler [D]) outside the present invention is added in such an amount as to give the optimal masking effect, any such sufficient improving effect as described above cannot be obtained. If its adding amount is increased, although the improving effect might surely be increased, fog density becomes so increased that it becomes impractical.

Further, the addition of a DIR coupler (comparative coupler [E]) and timing DIR coupler (comparative coupler [F]) outside the present invention, even though in the optimal amount, is unable to produce any sufficient improving effect. If the adding amount is increased, the color developing density becomes lowered prior to the sufficient obtaining of the intended effect of the present invention, and thus this is impractical also.

The independent use of each of comparative couplers [A], [B] and [C] shifts the λmax toward the shorter wavelength side, and thus it does not satisfy the object of the present invention. The independent use of naphthol-type cyan couplers outside the invention, although it causes the λmax to be a sufficiently longer wavelength and the Δλmax to be smaller, brings about discoloration by reduction as shown in Example 3, so that this way does not meet the object of the present invention, either.

In addition, a certain combination of some of the cyan couplers of the present invention can elongate the λmax. For example, the comparison of the $\lambda_{max}^{2.0}$ of each of comparative couplers (1-1) and (1-16) with that of the sample (1-3) of the invention shows that the combined use of two different couplers brings about a longer λmax than does the independent use of them. Thus it may be understood that the combination of couplers in the present invention has a unique effect beyond the expectation of the independent use.

EXAMPLE 2

The couplers as given in Table 2 were used in such combinations as shown in the table to be dispersed and then coated to thereby prepare samples (2-1) to (2-29).

The results obtained by developing these samples in the same manner as in Example 1 are as shown in Table 2. In addition, the $\lambda_{max}^{2.0}$, $\lambda_{max}^{0.5}$, Δλmax, and λs in Table 2 are as defined in Table 1.

TABLE 2

| Sample No. | Coupler | Additional coupler | $\lambda_{max}^{2.0}$ | $\lambda_{max}^{0.5}$ | Δλmax | $\lambda_s^{0.5}$ | Remarks |
|---|---|---|---|---|---|---|---|
| 2-1 | Exemplified compound (I-31) | — | 697 | 682 | 15 | 549 | comparative |
| 2-2 | Exemplified compound (I-31) | Comparative coupler [B] | 687 | 674 | 13 | 534 | " |
| 2-3 | Exemplified compound (I-31) | Exemplified compound (II-1) | 697 | 690 | 7 | 555 | invention |
| 2-4 | Exemplified compound (I-31) | Exemplified compound (II-22) | 698 | 697 | 1 | 564 | " |
| 2-5 | Exemplified compound (I-31) | Exemplified compound (II-6) | 697 | 692 | 5 | 559 | " |
| 2-6 | Exemplified compound (I-53) | — | 694 | 681 | 13 | 548 | comparative |
| 2-7 | Exemplified compound (I-53) | Exemplified compound (II-3) | 693 | 686 | 7 | 552 | invention |
| 2-8 | Exemplified compound (I-53) | Exemplified compound (II-8) | 695 | 689 | 6 | 554 | " |
| 2-9 | Exemplified compound (I-53) | Exemplified compound (II-33) | 695 | 695 | 0 | 562 | " |
| 2-10 | Exemplified compound (I-33) | — | 698 | 682 | 16 | 547 | comparative |
| 2-11 | Exemplified compound (I-33) | Exemplified compound (II-4) | 697 | 687 | 10 | 556 | invention |
| 2-12 | Exemplified compound (I-33) | Exemplified compound (II-7) | 697 | 690 | 7 | 560 | " |
| 2-13 | Exemplified compound (I-33) | Exemplified compound (II-28) | 698 | 697 | 2 | 565 | " |
| 2-14 | Exemplified compound (I-33) | Exemplified compound (II-46) | 697 | 697 | 0 | 566 | " |
| 2-15 | Exemplified compound (I-37) | — | 695 | 680 | 15 | 542 | comparative |
| 2-16 | Exemplified compound (I-37) | Exemplified compound (II-5) | 695 | 685 | 10 | 555 | invention |
| 2-17 | Exemplified compound (I-37) | Exemplified compound (II-24) | 696 | 690 | 6 | 562 | " |
| 2-18 | Exemplified compound (I-37) | Exemplified compound (II-29) | 695 | 687 | 8 | 558 | " |
| 2-19 | Exemplified compound (I-37) | Exemplified compound (II-35) | 695 | 689 | 6 | 561 | " |
| 2-20 | Exemplified compound (I-9) | — | 690 | 680 | 10 | 546 | comparative |
| 2-21 | Exemplified compound (I-9) | Exemplified compound (II-27) | 691 | 684 | 7 | 552 | invention |
| 2-22 | Exemplified compound (I-9) | Exemplified compound (II-34) | 691 | 687 | 4 | 555 | " |
| 2-23 | Exemplified compound (I-9) | Exemplified compound (II-51) | 693 | 692 | 1 | 562 | " |
| 2-24 | Exemplified compound (I-9) | Exemplified compound (II-50) | 692 | 690 | 2 | 560 | " |
| 2-25 | Exemplified | — | 694 | 681 | 13 | 549 | comparative |

TABLE 2-continued

| Sample No. | Coupler | Additional coupler | $\lambda_{max}^{2.0}$ | $\lambda_{max}^{0.5}$ | Δλmax | $\lambda_s^{0.5}$ | Remarks |
|---|---|---|---|---|---|---|---|
| | compound (I-17) | | | | | | |
| 2-26 | Exemplified compound (I-17) | Exemplified compound (II-1) | 694 | 685 | 9 | 555 | invention |
| 2-27 | Exemplified compound (I-17) | Exemplified compound (II-22) | 695 | 694 | 1 | 565 | " |
| 2-28 | Exemplified compound (I-17) | Exemplified compound (II-42) | 694 | 690 | 4 | 561 | " |
| 2-29 | Exemplified compound (I-17) | Exemplified compound (II-45) | 693 | 690 | 3 | 560 | " |

From the results shown in Table 2 it is also apparent that the ureido-substituted phenol-type cyan couplers of the present invention, when used independently, make the change in the λmax larger than the λmax in a lower density shifted toward the shorter wavelength side, and when used in combination, reduces extremely the above undesirable behavior.

EXAMPLE 3

Two sheets each of the samples (1-1) to (1-16) obtained in Example 1 were prepared and exposed in the same manner as in Example 1. After that, one of the sheets was processed in an ordinary way as made in Example 1, while the other was processed also in the same manner as in Example 1 with the exception that the bleaching bath composition in Example 1 was replaced with the following composition, thereby examining the discoloration of the cyan dye by reduction. The results are as shown in Table 3.

| Bleaching Bath Composition: | |
|---|---|
| Iron-ammonium ethylenediaminetetraacetate | 100 g |
| Diammonium ethylenediaminetetraacetate | 10 g |
| Ammonium bromide | 150 g |
| Hydrosulfite | 5 g |
| Glacial acetic acid | 10 ml |
| Water to make 1 liter | |
| Use 10N $H_2SO_4$ to adjust the pH to 5.5 | |

In addition, the dye residual percent in the table is as defined by the following formula, and means that the larger the percent, the smaller the discoloration by reduction.

$$\text{Dye residual percent} = \frac{\text{the Dmax obtained when processed in the above bleaching bath}}{\text{the Dmax obtained when processed in the bleaching bath in Example 1}} \times 100$$

TABLE 3

| Sample | Dye residual percent (%) |
|---|---|
| 1-1 | 100 |
| 1-2 | 96 |
| 1-3 | 92 |
| 1-4 | 94 |
| 1-5 | 92 |
| 1-6 | 93 |
| 1-7 | 88 |
| 1-8 | 100 |
| 1-9 | 85 |
| 1-10 | 87 |

TABLE 3-continued

| Sample | Dye residual percent (%) |
|---|---|
| 1-11 | 84 |
| 1-12 | 68 |
| 1-13 | 99 |
| 1-14 | 98 |
| 1-15 | 65 |
| 1-16 | 63 |

When considering collectively the results shown in both Table 3 and Table 1, it is understood that the combined use of the ureido-substituted phenol-type coupler and the naphthol-type coupler both in the present invention is the best way to realize a silver halide color photographic light-sensitive material required to be such that the hue of the cyan dye formed therefrom is in the longer wavelength region, the change in the hue according to image density is small, and the discoloration of the formed dye image by reduction is extremely small.

The coupler combinations different from those of the present invention produce dyes whose λmax unstably changes, which is discolored by reduction, and whose hue itself is inappropriate, thus being unable to attain the object of the present invention.

EXAMPLE 4

The couplers as shown in the "low-speed layer" of Table 4 were dispersed and coated in the same manner as in Example 1 with the exception that a red-sensitive low-speed silver iodobromide emulsion (containing 4 mole% silver iodide) with a mean particle size of 0.5μ, thereby obtaining red-sensitive low-speed emulsion-having samples. On the obtained samples, the couplers as shown in the "high-speed layer" of Table 4, with use of a red-sensitive high-speed silver iodobromide emulsion (containing 7 mole% silver iodide) with a mean particle size of 1.2μ, were coated in the same manner as in Example 1 so that the silver amount per unit area becomes equal to that of the bottom layer, whereby double-layer samples (4-1) to (4-12) were obtained. Each of the thus obtained samples was exposed to light and then processed in the same manner as in Example 1, and the results thus obtained are as shown in Table 4.

Besides, the results of the dye residual percent due to the discoloration by reduction found in the same manner as in Example 3 are also shown in Table 4.

The $\lambda_{max}^{2.0}$, $\lambda_{max}^{0.5}$, Δλmax, and $\lambda_s^{0.5}$ are as defined in Table 1. The dye residual percent is as defined in Table 3.

TABLE 4

| Sample | Low-speed layer Coupler | Adding q'ty* | High-speed layer Coupler | Adding q'ty* | $\lambda_{max}^{2.0}$ | $\lambda_{max}^{0.5}$ | Δλmax | $\lambda_{s}^{0.5}$ | Dye residual percent | Remarks |
|---|---|---|---|---|---|---|---|---|---|---|
| 4-1 | Exemplified compound (I-31) | 0.15 | Exemplified compound (I-31) | 0.04 | 697 | 682 | 15 | 549 | 99 | Comparative |
| 4-2 | Exemplified compound (I-31) | " | Exemplified compound (II-22) | " | 695 | 695 | 0 | 569 | 92 | Invention |
| 4-3 | Exemplified compound (I-31) | " | Exemplified compound (II-6) | " | 694 | 690 | 4 | 564 | 94 | " |
| 4-4 | Exemplified compound (I-31) | " | Exemplified compound (II-1) | " | 697 | 688 | 9 | 557 | 95 | " |
| 4-5 | Exemplified compound (I-31) + Exemplified compound (II-1) | 0.12 0.03 | Exemplified compound (I-31) | " | 697 | 690 | 7 | 555 | 97 | " |
| 4-6 | Exemplified compound (I-31) + Exemplified compound (II-22) | 0.12 0.03 | Exemplified compound (I-31) | " | 697 | 696 | 1 | 564 | 90 | " |
| 4-7 | Exemplified compound (I-31) | 0.15 | Exemplified compound (I-31) + Exemplified compound (II-26) | 0.01 0.03 | 696 | 695 | 1 | 568 | 94 | " |
| 4-8 | Exemplified compound (I-31) + Exemplified compound (II-1) | 0.12 0.03 | Exemplified compound (I-31) + Exemplified compound (II-22) | 0.02 0.02 | 696 | 696 | 0 | 568 | 94 | " |
| 4-9 | Exemplified compound (I-17) | 0.13 | Exemplified compound (I-31) + Exemplified compound (II-26) | 0.01 0.03 | 697 | 696 | 1 | 565 | 97 | " |
| 4-10 | Exemplified compound (I-31) | 0.15 | Comparative coupler [A] | 0.04 | 687 | 670 | 17 | 536 | 88 | Comparative |
| 4-11 | Exemplified compound (I-31) | " | Comparative coupler [C] | 0.04 | 683 | 667 | 16 | 535 | 99 | " |

Note:
*Molar value per mole of silver halide

It is apparent from Table 4 that the use in combination of the ureido-substituted phenol-type coupler and the naphthol-type coupler of the invention, whether they are together in a same layer or separately in different layers, reduces the change in the λmax, with the λmax in a lower density being sufficiently long, while on the other hand, the use in combination with different couplers outside the present invention is unable to produce any improving effect.

What is claimed is:

1. A silver halide color photographic light-sensitive material comprising a support having thereon one or more light-sensitive silver halide emulsion layers, wherein at least one of said light-sensitive silver halide emulsion layers contains a phenol-type cyan coupler having at the second position of the benzene nucleus thereof a group selected from the group consisting of a phenol-ureido group, a naphthyl ureido group and a heterocyclic ureido group, and having at the fifth position thereof an acylamino group, and at least one of said light-sensitive silver emulsion layers contains a naphthol-type cyan coupler which is substantially colorless and has a hydrogen atom or a group capable of splitting off a compound which does not inhibit the development of the coupling reaction at a coupling position with the oxidized product of an aromatic primary amine color developing agent, wherein said phenol-type cyan coupler is incorporated into a lower-speed emulsion layer having a color sensitivity and said naphthol-type cyan coupler is incorporated into a higher-speed emulsion having the same color sensitivity.

2. The silver halide color photographic light-sensitive material according to claim 1, wherein said phenol type cyan coupler is contained in a silver halide emulsion layer, in a quantity of 0.03 to 0.5 mole per mole of the silver halide of said layer.

3. The silver halide color photographic light-sensitive material according to claim 1, wherein said naphthol type cyan coupler is contained in a silver halide emulsion layer, in a quantity of 0.15 to 0.5 mole per mole of the silver halide of said layer.

4. The silver halide color photographic light-sensitive material according to claim 1, wherein said naphthol type cyan coupler is a two-equivalent coupler having a substituent at the active site thereof.

5. The silver halide color photographic light-sensitive material according to claim 1, wherein said phenol type cyan coupler is dispersed in a silver halide emulsion layer by being dissolved in an alkyl ester of phthalic acid.

6. The silver halide color photographic light-sensitive material according to claim 1, wherein said coupler having said Formula [II] are contained in said material in the quantity of 0.05–0.5 mole per mole of said coupler having said Formula [I] contained in said material.

7. The silver halide color photographic light-sensitive material according to claim 1, wherein said phenol-type cyan coupler has the following Formula [I] and said naphthol-type cyan coupler has the following Formula [II]:

Formula [I]

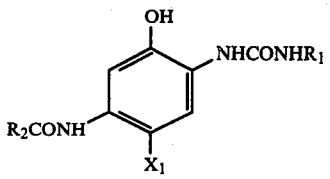

wherein $X_1$ is a hydrogen atom or a group splittable by the coupling reaction with the oxidized product of an aromatic primary amine color developing agent; $R_1$ is a naphthyl group or a heterocyclic group (provided the carbon atom of the heterocyclic group is coupled to the nitrogen atom of the ureido group) or a phenyl group having at least one substituent selected from the class consisting of trifluoromethyl, nitro, cyano, —COR, —COOR, $—SO_2R$, $—SO_2OR$,

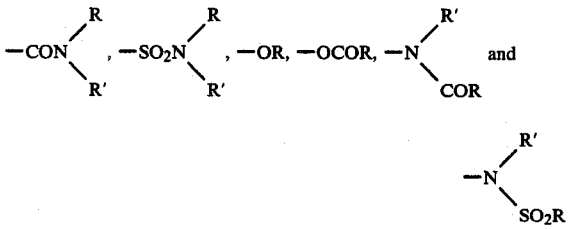

wherein R is an aliphatic or aromatic group, and R′ is a hydrogen atom, an aliphatic or aromatic group; and $R_2$ is a ballasting group necessary to cause said cyan coupler having said Formula [I] and the cyan dye formed from said cyan coupler to be nondiffusible, Formula [II]

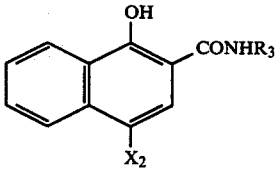

wherein $R_3$ is an aliphatic, an aromatic or a heterocyclic group; and $X_2$ is a hydrogen atom or a group which can be split off by the coupling reaction with the oxidized product of an aromatic primary amine color developing agent and which, after being split off, will not inhibit the development.

8. The silver halide color photographic light-sensitive material according to claim 7 wherein said phenol type cyan coupler has the following Formula [Ia] or [Ib]:

Formula [Ia]

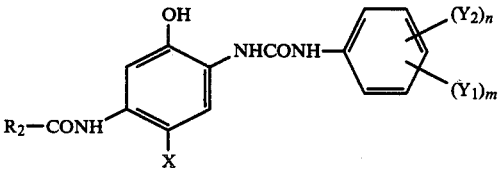

-continued

Formula [Ib]

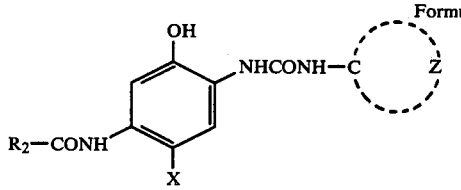

wherein $Y_1$ is trifluoromethyl, nitro, cyano, —COR, —COOR, $—SO_2R$, $SO_2OR$,

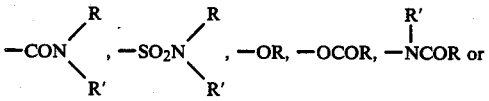

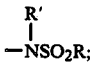

R is an aliphatic group or an aromatic group; R′ is hydrogen or a group represented by R; $Y_2$ is a monovalent group, m and n each is an integer of from 0 to 3, $m+n \leqq 5$, and Z is a group of nonmetallic atoms necessary to form a heterocyclic group or naphthyl group; $R_2$ represents an aliphatic group, an aromatic group or a heterocyclic group necessary to cause a cyan coupler having Formula [I] and the cyan dye formed from the cyan coupler to be nondiffusible; and X is hydrogen or a group which can be split off during the coupling reaction with the oxidized product of a color developing agent.

9. The silver halide color photographic light-sensitive material according to claim 8, wherein a aliphatic group represented by R in said Formulae [Ia] and [Ib] is an alkyl group having 1 to 10 carbon atoms and an aromatic group represented by said R therein is a phenyl group.

10. The silver halide color photographic light-sensitive material according to claim 8, wherein said monovalent group represented by $Y_2$ in said respective Formulae [Ia] and [Ib] is an aliphatic group, an aromatic group, a halogen atom, an amino group, a hydroxy group or a substituent represented by $Y_1$ in said Formulae [Ia] and [Ib].

11. The silver halide color photographic light-sensitive material according to claim 10, wherein said aliphatic group represented by $Y_2$ in said Formula [Ia] and [Ib] is an alkyl group having 1 to 10 carbon atoms and said aromatic group is a phenyl group or a naphthyl group.

12. The silver halide color photographic light-sensitive material according to claim 8, wherein said group of nonmetallic atoms necessary to form a heterocyclic group or naphthyl group, represented by Z in said respective Formulae [Ia] and [Ib], is a 5- or 6-member heterocyclic ring containing 1 to 4 nitrogen, oxygen or sulfur atoms.

13. The silver halide color photographic light-sensitive material according to claim 8, wherein said aliphatic group, aromatic group or heterocyclic group represented by $R_2$ in said respective Formulae [Ia] and [Ib] is an alkyl group having 4 to 30 carbon atoms, an aryl group or a heterocyclic group.

14. The silver halide color photographic light-sensitive material according to claim 8, wherein $Y_1$ is $SO_2R$ wherein R represents the same group as defined in claim 3, and m is 1 and n is 0.

15. The silver halide color photographic light-sensitive material according to claim 7, wherein $R_3$ in said Formula [II] is a ballasting group which causes said coupler and the cyan dye formed therefrom to be sufficiently nondiffusible.

16. The silver halide color photographic light-sensitive material according to claim 7, wherein said split-off group capable of being split off by a coupling reaction, represented by $X_2$ in said Formula [II], is a split-off group that is to be combined with a coupler residue by an oxygen atom.

17. The silver halide color photographic light-sensitive material according to claim 16, wherein said split-off group to be combined with a coupler residue by an oxygen atom, which is represented by $X_2$ in said Formula [II], is a group having the following Formula [IIa], $$-O-R_7-Z_2-R_8 \qquad \text{Formula [IIa]}$$

wherein $R_7$ represents a saturated or unsaturated divalent aliphatic group or divalent aromatic group; $Z_2$ represents $$-\overset{\overset{R_9}{|}}{CON}-,\ -SO_2\overset{\overset{R_9}{|}}{N}-,$$

—NHCO—, —SO—, —$SO_2$—, —$NHSO_2$—, —CO—, —COO—, —S—, —O—, or a mere bonding hand; and $R_8$ and $R_9$ each is a hydrogen atom or an aliphatic group, an aromatic group or a heterocyclic group.

18. The silver halide color photographic light-sensitive material according to claim 17, wherein said aliphatic group represented by $R_8$ and $R_9$ in said Formula [IIa] is an alkyl group, said aromatic group is an aryl group and said heterocyclic group is the residue of a 5- or 6-member heterocyclic ring containing such hetero atom as nitrogen, sulfur, oxygen atom.

19. The silver halide color photographic light-sensitive material according to claim 16, wherein said split-off group to be combined with a coupler residue by an oxygen atom, represented by $X_2$ in said Formula [II], is a group having the following Formula [IIb], $$-O-(CH_2)_n-Z_3-R_8 \qquad \text{Formula [IIb]}$$

wherein n is an integer of from 1 to 3; $Z_3$ is $$-\overset{\overset{R_9}{|}}{CON}-,$$

—COO—, —CO—, or —$SO_2$—; and $R_8$ and $R_9$ are as defined in the $R_8$ and the $R_9$ of Formula [IIa].

20. The silver halide color photographic light-sensitive material according to claim 7, wherein said $R_3$ designated in said Formula [II] is an alkyl or a cycloalkyl group.

21. The silver halide color photographic light-sensitive material according to claim 7, wherein said couplers having said Formulae [I] and [II] respectively are contained in a red-sensitive silver halide emulsion layer.

* * * * *